US005798775A

United States Patent [19]

Takahashi et al.

[11] Patent Number: 5,798,775

[45] Date of Patent: Aug. 25, 1998

[54] INK JET RECORDING APPARATUS

[75] Inventors: Kazuyoshi Takahashi; Kazuaki Masuda, both of Kawasaki; Yoshiaki Takayanagi; Akio Suzuki, both of Yokohama; Mitsuru Kurata, Kawasaki; Tsutomu Abe, Isehara; Seiichiro Karita, Yokohama; Hiroshi Tajika, Yokohama; Noribumi Koitabashi, Yokohama; Haruo Uchida, Yokohama; Kentaro Yano, Yokohama; Hitoshi Sugimoto, Yokohama; Miyuki Matsubara, Tokyo, all of Japan

[73] Assignee: Canon Kabushiki Kaisha, Tokyo, Japan

[21] Appl. No.: 766,890

[22] Filed: Dec. 13, 1996

Related U.S. Application Data

[62] Division of Ser. No. 818,587, Jan. 9, 1992, abandoned.

[30] Foreign Application Priority Data

| | | | |
|---|---|---|---|
| Jan. 11, 1991 | [JP] | Japan | 3-2238 |
| Jan. 11, 1991 | [JP] | Japan | 3-2240 |
| Jan. 19, 1991 | [JP] | Japan | 3-4743 |
| Jan. 19, 1991 | [JP] | Japan | 3-4745 |
| Jan. 19, 1991 | [JP] | Japan | 3-4746 |
| Jan. 19, 1991 | [JP] | Japan | 3-4747 |

[51] Int. Cl.[6] ..... B41J 2/165

[52] U.S. Cl. ..... 347/33

[58] Field of Search ..... 347/22, 23, 33, 347/44, 24

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,577,203 | 3/1986 | Kawamura | 346/140 R |
| 4,635,080 | 1/1987 | Watanabe | 347/50 |
| 4,723,129 | 2/1988 | Endo et al. | 346/1.1 |
| 4,739,340 | 4/1988 | Terasawa | 346/1.1 |
| 4,740,796 | 4/1988 | Endo et al. | 346/1.1 |
| 5,049,898 | 9/1991 | Arthur et al. | 347/19 |
| 5,081,472 | 1/1992 | Fisher | 347/33 |
| 5,138,344 | 8/1992 | Ujita et al. | 346/140 R |
| 5,182,582 | 1/1993 | Okamura | 346/140 R |
| 5,266,974 | 11/1993 | Koitabashi et al. | 347/33 |
| 5,479,194 | 12/1995 | Hirano et al. | 347/22 |

FOREIGN PATENT DOCUMENTS

| | | | |
|---|---|---|---|
| 0398348 | 11/1990 | European Pat. Off. . | |
| 54-056847 | 5/1979 | Japan . | |
| 59-45162 | 3/1984 | Japan | B41J 3/04 |
| 59-123670 | 7/1984 | Japan . | |
| 59-138461 | 8/1984 | Japan . | |
| 60-071260 | 4/1985 | Japan . | |
| 62-113554 | 5/1987 | Japan | 347/33 |
| 1-018642 | 1/1989 | Japan . | |
| 1-043885 | 2/1989 | Japan . | |
| 2-167755 | 6/1990 | Japan . | |
| 3-073352 | 3/1991 | Japan . | |
| 3-240554 | 10/1991 | Japan . | |

*Primary Examiner*—John E. Barlow, Jr.

*Attorney, Agent, or Firm*—Fitzpatrick, Cella, Harper & Scinto

[57] ABSTRACT

An ink jet recording device includes a recording head unit having discharge ports for discharging ink, ink channels communicating to the discharge ports and leading the ink thereto, and an ink tank unit for storing ink to be supplied to the recording head unit. The recording head unit consists of a device for storing parameter information concerning the ink discharge characteristics, and a protective member disposed on a side face area adjacent to the discharge port formation face for preventing the ink from flowing around.

36 Claims, 20 Drawing Sheets

INK JET RECORDING APPARATUS

This application is a division, of application Ser. No. 07/818,587 filed Jan. 9, 1992, now abandoned.

BACKGROUND OF THE INVENTION

1. Field of the Invention

The present invention relates to an ink jet recording apparatus.

2. Related Background Art

Conventionally, there are ink jet recording apparatuses comprising recovery units for removing wet ink on the surface having an array of discharge ports caused by the ink mist occurring in discharging the ink from recording head, or the satellite ink occurring in refilling the ink, and the suction residual ink occurring in the recovery process such as the suction. This recovery apparatus is mainly comprised of a suction unit, for example, for forcing the ink to be discharged from the discharge port, and a wiping unit for wiping and cleaning the discharge port array face. In order to make the wiping (or cleaning) of the discharge port array face (hereinafter referred to as a discharge face) for an ink jet recording head having a plurality of discharge ports, for example, the wiping unit is constituted so as to wipe, in a scraping manner, the discharge port array face with a blade made of an elastic material placed directly against the discharge face while moving the blade relative to the ink jet recording head, to thereby clean the discharge port and its surrounding to maintain the stability of discharging.

Here, taking an example of ink deposition on the discharge face which may appear with the suction recovery, a conventional cleaning operation will be described with reference to FIG. 29.

A carriage 902 having an ink jet recording head 901 is carried on a main scan rail 903, and attached movably in a print direction (direction of arrow C). If the discharge port of the ink jet recording head 901 may be clogged, a holder 905 having gum caps 904 forming a closed system for the head is moved in a direction of arrow a by driving means, not shown, so that the gum caps 904 are brought into contact with the discharge face 901*a* of the ink jet recording head 901 and stopped at a position where the closed system is created. In this state, the suction recovery is performed via tubes 906 with a suction pump 907. The ink pulled out from the ink jet recording head 901 due to the suction is transported via a tube 908 into a waste ink processing member 909. After the suction recovery, the holder 905 having the gum caps 904 are retracted in the direction of arrow b by the driving means. At this time, ink droplets I pulled out from nozzles may remain on the discharge port 901*a* of the ink jet recording head 901. The carriage 902 having the ink jet recording head 901 is moved in the direction of arrow C [(A) state], the wiping for the discharge port 901*a* is performed with a gum blade 910 carried by a blade holder 911 [(B) state], whereby ink droplets I on the discharge face 901 are removed from the discharge face 901*a*.

However, to improve the cleaning performance for the discharge face of ink jet recording apparatus and stabilize the discharge characteristics in a long term service, there are conventionally the following problems, particularly in a color recording apparatus having a cartridge-type head or a plurality of heads.

The first problem is that the ink accumulating in a gap between the head and the carriage may cause an adverse effect.

That is, there is a fear that in wiping ink droplets remaining on the discharge face of head after the print or suction, the ink may enter the gap between the head and the carriage, as shown in the (B) state of FIG. 29, and the accumulating ink may drip after a long term of service or scatter away due to the engagement with the blade, thereby polluting a print face or back face of print sheet. Also, there is a further fear that when the accumulating ink contains dust or thickens, it may be retransferred onto the blade in cleaning to enter the discharge ports of the head downstream in the wiping direction, thereby causing a print deflection or undischarge. Further, the undischarge owing to intermixed dust or thickened ink may exert the adverse effect on energy generating elements for use in discharging the ink (e.g., scorching of heat generating element).

Second, there is a problem of the adverse effect due to the swept ink in wiping.

That is, most recent ink jet recording heads have a plurality of discharge ports arranged, so that the wiping is carried out with a wider blade than a discharge port array range. However, considerably greater amount of ink droplets may remain if the number of discharge ports increases, and this ink tends to remain on the discharge port array facing downstream of the blade in the wiping direction. If ink droplets remaining on this portion may be fixed in a long term service, an failure of enclosing a cap portion may occur. If this occurs, the print deflection or undischarge is likely to occur due to capping failure with the non-used recording head, and further a failure of suction or wiping may arise.

Further, thirdly, with the apparatus having a plurality of heads corresponding to the inks differing in the color tone, if the wiping is made for such heads in sequence, there is a fear that the adhering ink (wet ink) to the discharge face in the vicinity of discharge ports of the head upstream of the wiping may be transferred onto the blade in wiping after the ink suction or print, and the inks different in the color may enter discharge ports of the head downstream thereof. Thus, the color mixture of different ink colors or the undischarge failure due to the mixture of different components may occur.

Further, fourthly, there is a problem associated with the exchange of a cartridge type head. That is, when the cartridge type head is exchanged, the operator may dirty his hands or clothes with the exchange of the head if the head is polluted with the adhering ink for the above reason.

On the other hand, in order to make the recording at high precision or with high quality, it is required to reduce the dispersion between product heads as least as possible. To meet this requirement, a method has been proposed in which data concerning the uneven density for each head is measured in fabricating the ink jet head, and the correction data for correcting the driving condition of head or various characteristics for the image processing are prewritten into a semiconductor memory (e.g., ROM) which is mounted on the product, thereby controlling the discharge and improving the previous problem.

Though the cleaning of discharge ports is an important factor for improving the recording quality in the ink jet recording as previously described, the wiped out ink may be scattered away with the restoring force of a cleaning blade due to its elasticity which may be separated from discharge port formation face, in cleaning the discharge port formation face with the wiping of the cleaning blade. Thus, there is a fear that the apparatus may be internally polluted with such scattered ink, or the ink may flow around the side face of head, and stick to the memory device provided on the head, causing a malfunction or breakdown.

SUMMARY OF THE INVENTION

It is an object of the present invention to provide recording means which can resolve those problems and attain a high quality of recording, and an ink jet recording apparatus with said recording means mounted thereon.

In order to resolve the aforementioned problems, the present invention provides an absorbing member for wiping out the ink adhering to a cleaning blade between recording heads. In particular, the absorbing member is disposed between each recording head to clean the blade while at the same time cleaning the discharge port face of recording head. Also, the absorbing member between recording heads may be mounted on the side face of recording head, or on the portion between each recording head mounting unit of a carriage for mounting the recording head.

The present invention has been proposed to accomplish the aforementioned objects, in which a view has been obtained that an ink permeation preventing member provided in the neighborhood of the discharge port formation face and on the side face of head can offer the favorable effect in order to clean excellently a discharge port formation face of recording head without the occurrence of the ink sticking to a semiconductor memory or the ink mist flying within the apparatus.

On the basis of such a view, the present invention provides recording means having integrally a recording head unit having discharge ports for discharging the ink and ink channels communicating to said discharge ports and leading the ink thereto, and an ink tank unit for storing the ink to be supplied to the recording head unit, characterized in that said recording head unit comprises a device for storing the parameter information concerning the ink discharge characteristics, and a protective member disposed on a side face area adjacent to said discharge port formation face for preventing the ink from flowing around.

Also, there is provided recording means having integrally a recording head unit having a device for storing the parameter information concerning the ink discharge characteristics, as well as having discharge ports for discharging the ink and ink channels communicating to said discharge ports and leading the ink thereto, and a protective member disposed on the area adjacent to said discharge port formation face for preventing the ink from flowing around, and an ink tank unit for storing the ink to be supplied to the recording head unit, characterized by comprising a recording head cartridge mounted on the apparatus so as to be freely detachable therefrom, a support member having an electrical connecting portion for passing a recording signal to said recording head cartridge mounted, and a cleaning member disposed on a region out of the recording area with said recording head cartridge for cleaning said discharge port formation face while being in direct contact with said discharge port formation face.

With such a constitution, it is possible to provide highly reliable recording means capable of attaining a high quality of recording, and an ink jet recording apparatus with the recording means mounted, while preventing the ink mist from scattering within the apparatus, as well as preventing the flying ink from sticking to a semiconductor memory or electrical contact point mounted on an ink head cartridge.

Also, the present invention has been proposed to accomplish the aforementioned objects, in which a view has been obtained that the adhering ink on the blade can be wiped out more surely by setting a blade cleaning mode. On the basis of this view, the present invention provides an ink jet recording apparatus having a cleaning member for cleaning a discharge port face of a recording head for recording with the discharge of the ink, characterized by comprising a cleansing member for cleansing said cleaning member while being in contact with said cleaning member, and means for setting a first cleaning mode of cleaning said discharge port face and a second cleaning mode of cleansing said cleaning member with said cleansing member.

That is, porous absorbing members are provided on a carriage having recording heads mounted thereon, particularly, on the portion before and after a recording head in the cleaning direction, so that the ink transferred to the blade in wiping a previous recording head is absorbed into its absorbing member not to cause any trouble such as residual ink or mixed color to occur in the recording head to be wiped next, and further a blade cleaning mode switch is provided or a blade dedicated cleaning mode is set so that the blade cleaning mode may be made effective for every predetermined number of sheets.

This blade cleaning mode is one in which the penetrating amount of the blade is set to be deeper than at the ordinary wiping, and the cleaning is performed for a wider range than that placed into contact with the blade at the wiping of predetermined intervals, in a single direction or both directions by a predetermined number. With such blade cleaning mode, it is possible to remove residual ink on the blade more fully, which can not be absorbed into the absorbing member at the normal wiping, and accomplish a more reliable wiping.

Further, the present invention provides an ink jet recording apparatus for recording with the discharge of the ink onto a recording medium, characterized by comprising a wiping member for wiping by engaging a face of said recording head provided with said discharge ports each having a shape not to be in line symmetry about a predetermined axis, and wiping direction defining means for defining the wiping direction so that said wiping member may make the wiping from shorter to longer side of two discharge port peripheral length components lying on both sides of said predetermined axis with respect to a line segment having the maximum length with which said predetermined axis is intercepted by a contour line of said discharge port.

Here, the predetermined axis is taken as an axis perpendicular to said wiping direction.

The discharge port may be shaped as a polygon, or a polygon having rounded corners.

When the discharge port is shaped as a trapezoid having an upper base and a lower base parallel to said predetermined axis, the line segment of the maximum length is equal to the lower base, so that the shorter discharge port peripheral length component is the lower base, and the longer discharge port peripheral length component is the upper base plus two oblique lines.

On the other hand, the present invention provides a recording head having discharge ports for the discharge of the ink onto a recording medium, each discharge port being of a shape not in line symmetry about a predetermined axis, characterized in that the face of the recording head having said discharge ports is wiped by engagement with the wiping member from shorter to longer side of two discharge port peripheral length components lying on both sides of said predetermined axis with respect to a line segment having the maximum length with which said predetermined axis is intercepted by a contour line of said discharge port.

According to the present invention, owing to the ability of determining the wiping direction suitable for the shape of a discharge port, an ink jet recording head provided with discharge ports each having a complex shape or special shape in consideration of the stabilization of discharge characteristics, and liquid channels, makes it possible to prevent dust or thickened ink from returning inward to the discharge ports with the wiping, as well as reducing the pulling out of the ink from the discharge ports in wiping and the color mixture in wiping a plurality of heads, so that the image quality can be stably maintained, with reduced recording deflection or undischarge, by realizing the stabilization in the discharge characteristics of the head as well as the improvement of the reliability. In particular, when the discharge port is formed as a polygon (or a polygon having rounded corners), there is a great effect in wiping the ink jet recording head.

Further, the present invention is aimed to resolve the above-mentioned problems, and comprises a discharge portion for discharging the ink to a recording medium, characterized in that an end face of said absorbing member is convex relative to an end face of said discharge portion, and/or the end face of said discharge portion adjacent to said absorbing member is concave relative to the end face of said absorbing member.

Also, an ink jet head cartridge of the present invention is characterized in that an ink jet recording head has integrally an ink tank for storing the ink to be supplied to said head.

Also, an ink jet recording apparatus of the present invention is characterized by comprising a recording head, a mounting member for mounting said recording head, a wiping member engageable with an end face of said discharge portion and an end face of said absorbing member, and wiping direction defining means for defining the wiping direction so that said wiping member may engage the end face of said absorbing member after engaging the end face of said discharge portion.

Further, an ink jet recording apparatus of the present invention is characterized by comprising a recording head having a discharge portion for discharging the ink to a recording medium and a first absorbing member provided in the vicinity of said discharge portion, a mounting member for mounting said recording head, a second absorbing member provided on said mounting member adjacent to and in the vicinity of the first absorbing member, a wiping member engageable with said discharge portion, said first absorbing member and said second absorbing member, and wiping direction defining means for defining the wiping direction so that said wiping member may engage said first absorbing member after engaging said discharge portion, and then said second absorbing member.

The discharge portion has means for generating the heat energy to cause the film boiling in the ink as the energy useful for discharging the ink.

The recording head is in the form of a head cartridge having integrally an ink tank for storing the ink to be supplied to said discharge portion.

Further, said mounting member can mount a plurality of recording heads, each of which is mounted so that said absorbing member is disposed in the same direction, or said second absorbing member is disposed downstream of each of said recording heads in the wiping direction.

Here, said plurality of recording heads can be provided corresponding to the inks different in the color tone.

Further, a cleaning method of the present invention is characterized in that for a recording head having a discharge portion for discharging the ink to a recording member and a first absorbing member provided in the vicinity of said discharge portion, after the cleaning with said wiping member engaging said discharge portion, said wiping member is caused to engage said first absorbing member, and then said second absorbing member provided on a mounting member for said recording head to be adjacent to said first absorbing member.

Here, said wiping member can be used in the continuous operation for a plurality of recording heads and a plurality of second absorbing members.

According to the present invention, it is possible to clean the wiping member in such a manner as to cause the wiping member to engage an absorbing member disposed in the vicinity of the discharge portion of recording head, after wiping the discharge portion, or an absorbing member provided on a head mount such as carriage. Also, it is possible to perform the absorbing operation of the ink more securely by making the absorbing member on the head side convex, and/or the end face on the discharge portion concave.

Accordingly, as impurities having the adverse effect on the head such as dust or thickened or fixed ink adhering to the wiping member or cap can be removed beforehand, and efficiently, an excellent effect can be exhibited against conventional troubles such as a trouble of the ink accumulating in the gap between head and carriage, a trouble of the ink swept in wiping, the color mixture in wiping a plurality of heads, or the pollution of the operator in exchanging the cartridge head, with an improved durability and print characteristic.

Also, the present invention is provided with a discharge portion for discharging the ink to a recording member and an absorbing member provided in the vicinity of said discharge portion, characterized in that assuming that the ink capacity of ink tank for storing the ink to be supplied to said discharge portion is I[g], and the volume of said absorbing member is A[$cm^3$], the relation of $1/15000 < A/I < 1/5$ stands.

Here, assuming that the weight of ink to be usable for recording among the ink stored within said ink tank is L*[g], the relation of $1/12500\ A/I^* < 3/10$ stands.

Also, said absorbing member can be made of a material having a swelling rate of 0.02% or less in absorbing the liquid.

Further, said absorbing member can be made of a material having a liquid absorbing rate of 30% to 60%.

Further, an ink jet recording apparatus of the present invention is characterized by comprising a recording head having a discharge portion for discharging the ink to a recording medium and an absorbing member provided in the vicinity of said discharge portion, a mounting member for mounting said recording head, a wiping member engageable with said discharge portion and said absorbing member, and wiping direction defining means for defining the wiping direction so that said wiping member may engage said absorbing member after engaging said discharge portion.

In addition, a cleaning method of recording head according to the present invention is characterized in that for a recording head having a discharge portion for discharging the ink to a recording member and an absorbing member provided in the vicinity of said discharge portion, after cleaning with said wiping member engaging said discharge portion, said wiping member is caused to engage said absorbing member.

Here, said wiping member can be used in the continuous operation for a plurality of recording heads.

According to the present invention, it is possible to clean the wiping member in such a manner as to cause the wiping member to engage the absorbing member after wiping of the discharge portion, with the absorbing member provided adjacent to the discharge portion of recording head.

Accordingly, as impurities having the adverse effect on the head such as dust or thickened or fixed ink adhering to the wiping member or cap can be removed beforehand, and efficiently, an excellent effect can be exhibited against conventional troubles such as a trouble of the ink accumulating in the gap between head and carriage, a trouble of the ink swept in wiping, the color mixture in wiping a plurality of heads, or the pollution of the operator in exchanging the cartridge head, with an improved durability and print characteristic.

Further, according to the present invention, it is possible to derive the optimum condition on the constitution for the absorbing member in the respect of size, function and cost, by making clear the swelling rate and the liquid absorbing rate of absorbing member provided on the head, as well as the relation between the ink weight within the ink tank, the recordable ink weight, and the size of absorbing member.

The present invention has been achieved in the light of the above-mentioned problems, and comprises a recording head having a discharge portion for discharging the ink to a recording medium and an absorbing member provided in the vicinity of said discharge portion, and a wiping member engageable with said discharge portion and said absorbing member, characterized in that the following relation can stand, the range of discharge port array<the width of wiping member≦the width of absorbing member.

Further, there is provided a mounting member for mounting the head, wherein said member can mount a plurality of recording heads, each of which is mounted so that said first absorbing member is disposed in the same direction, or said second absorbing member is disposed downstream of each of said recording heads in the wiping direction.

Here, said plurality of recording heads can be provided corresponding to the inks different in the color tone.

According to the present invention, it is possible to cleanse the wiping member more surely in such a manner that with the appropriate dimensions, an absorbing member is disposed in the vicinity of the discharge portion for the recording head, and the wiping member is caused to engage the absorbing member after wiping the discharge portion, and further engage an absorbing member provided on the head mount such as carriage.

Accordingly, as impurities having the adverse effect on the head such as dust or thickened or fixed ink adhering to the wiping member or cap can be removed beforehand, and efficiently, an excellent effect can be exhibited against conventional troubles such as a trouble of the ink accumulating in the gap between head and carriage, a trouble of the ink swept in wiping, the color mixture in wiping a plurality of heads, the pollution of the operator in exchanging the cartridge head, with an improved durability and print characteristic.

DETAILED DESCRIPTION OF THE PREFERRED EMBODIMENTS

Examples

The present invention will be described in detail with reference to the drawings.

(1) Head cartridge

Figure 1:
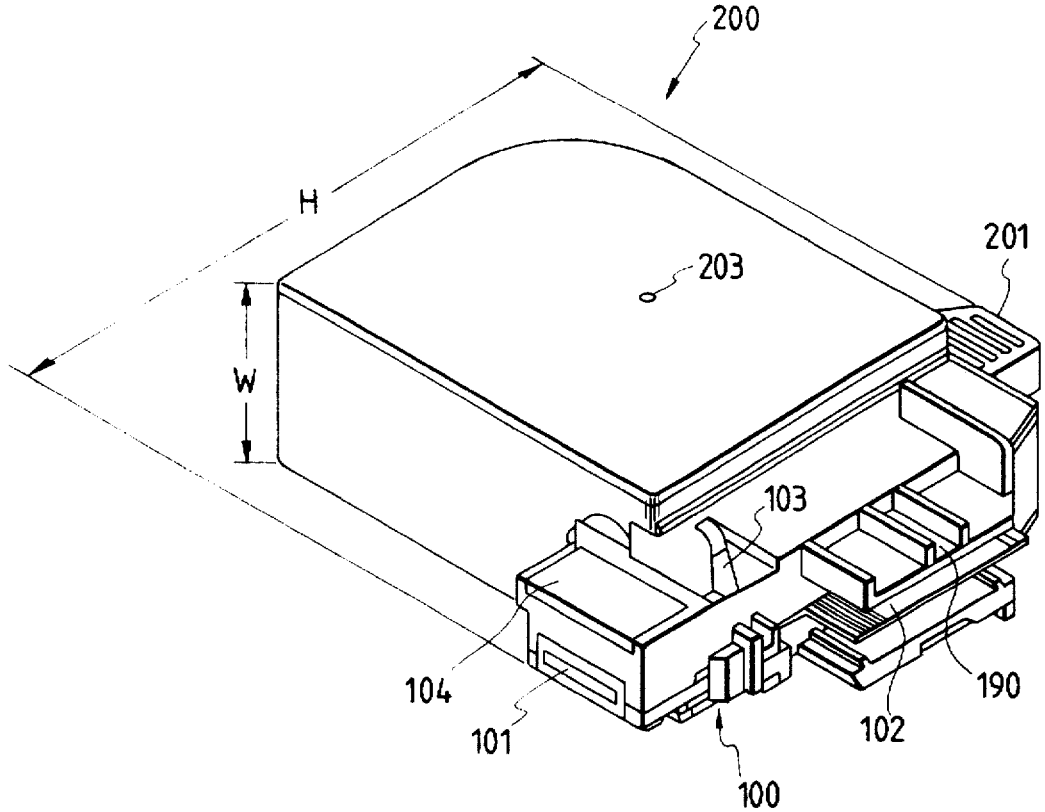
FIG. 1 is a perspective view showing an external constitution for a head cartridge mountable on a carriage of an ink jet recording apparatus in one example.

FIG. 1 shows one constitutional example of a head cartridge mountable on a carriage of an ink jet recording apparatus in this example. The cartridge in this example has an ink tank unit 200 and a head unit 100 integrated together, the head unit 100 being mountable on the ink tank unit 200 as will be described later. A wiring connector 102 for outputting an ink residual amount detection signal as well as receiving a signal for driving an ink discharge portion 101 of the head unit 100 is provided at a position juxtaposed with the head unit 100 and the ink tank unit 200. Accordingly, the height H of the cartridge can be lowered in the attitude with the cartridge mounted on the carriage as thereinafter described, and further the thickness of the cartridge can be thinner. Thereby, it is possible to make smaller the carriage to arrange cartridges side by side, as will be described in FIG. 19.

The head cartridge can be mounted onto the carriage by grasping a knob 201 provided on the ink tank unit 200, with the discharge portion 101 facing downward. And in mounting, a pin provided on the carriage side engages a pin engaging portion 103 of the head unit 100 so as to position the head unit 100.

The head cartridge in this example has an absorbing member 104 juxtaposed with the ink discharge portion 101, which serves to clean a member for wiping and cleansing a surface of the ink discharge portion 101. An atmosphere communicating port 203 for introducing the air in consuming the ink is provided in an almost central portion of the ink tank unit 200.

Figure 2:
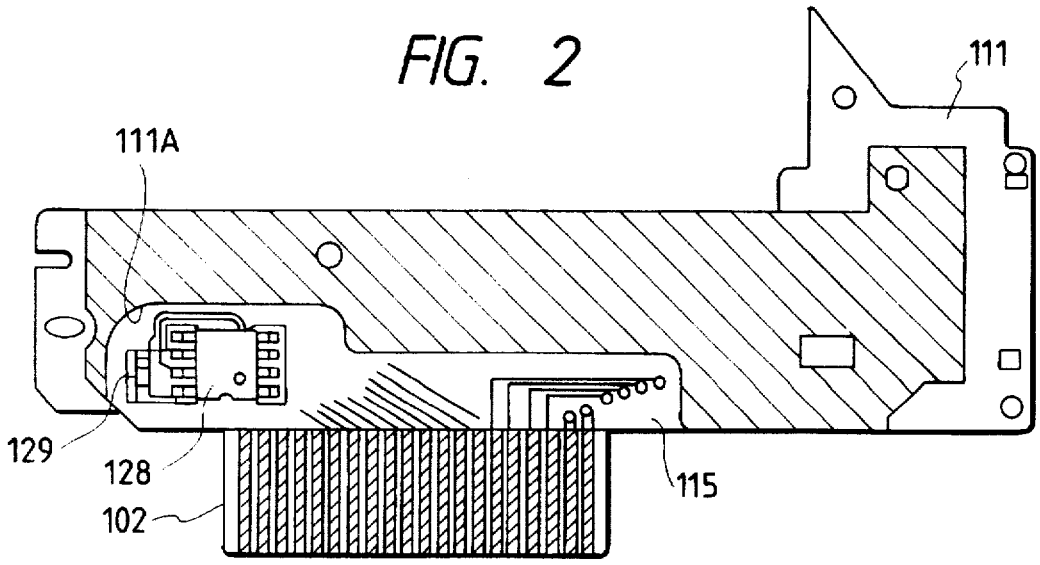
FIG. 2 is a plan view for explaining the joining relation between a base plate and PCB in a head unit of the head cartridge.

FIG. 2 is a bottom view showing a base plate 111 and PCB 115 integrated together, the PCB 115 having a contour indicated by a bold solid line and the base plate 111 indicated by a contour with the hatching. As shown, an IC 128 in the ROM form for storing the information intrinsic to the head, for example, the proper driving condition for electricity-heat converters, the ID number, the ink color information, the driving condition correction data (head shading (HS) data), the PWM control condition and a condenser 129 are disposed on the side of a connection surface between the PCB 115 and the base plate 111, and at a position corresponding to a cut-away portion 111A of the base plate 111. Hence, if the height of mounting the IC is less than the thickness of the base plate 111, the IC will not protrude over the surface when the PCB 115 and the base plate 111 are joined. Accordingly, in the fabrication process, it is unnecessary to take into consideration a storage form corresponding to its protrusion.

(2) Outline of recovery unit

A recovery unit in this example will be described below.

Figure 3:
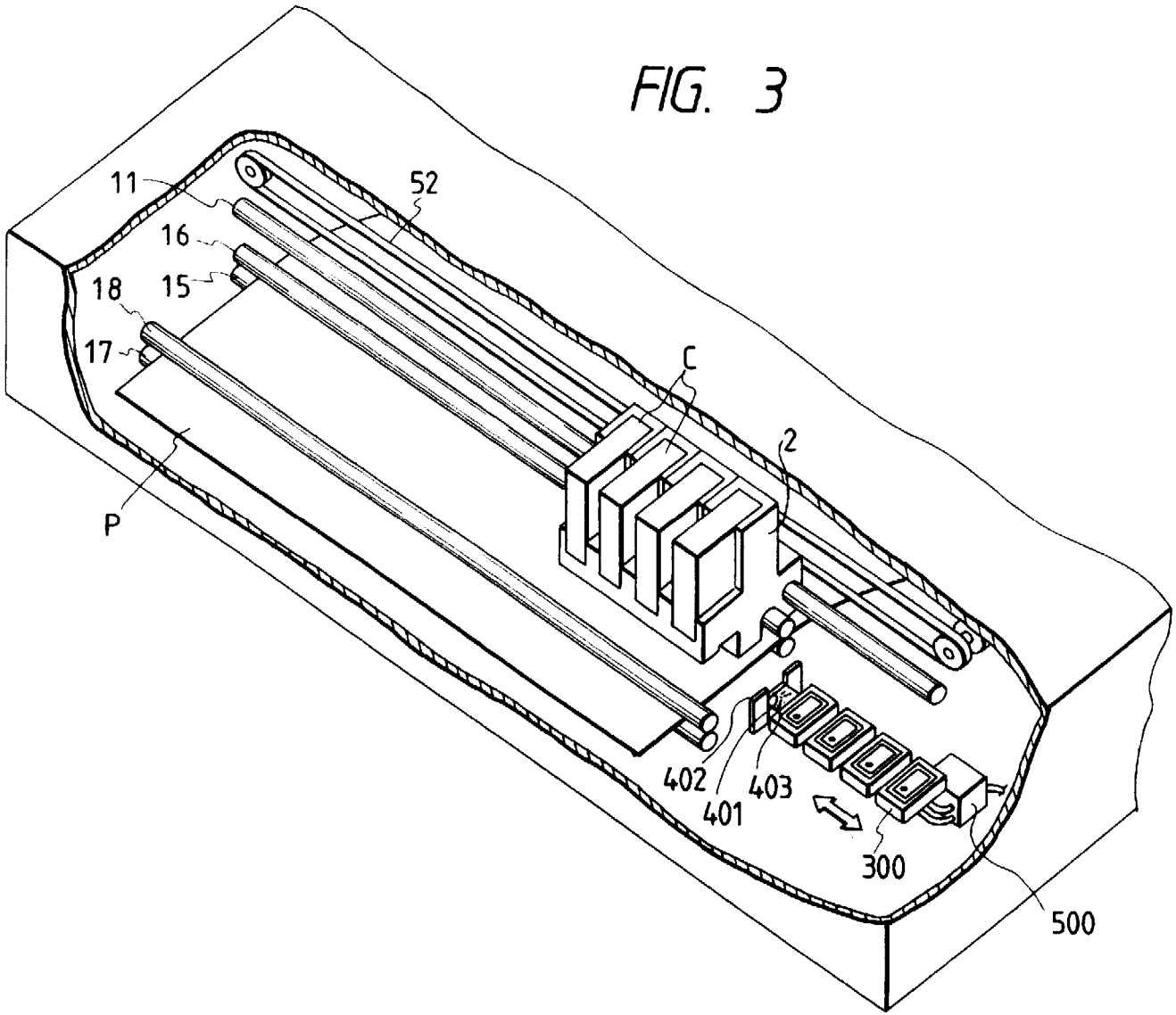
FIG. 3 is a typical perspective view of the ink jet recording apparatus.

FIG. 3 is a typical view of an ink jet recording apparatus for explaining a disposed region and the schematic constitution for a recovery unit of the ink jet recording apparatus, wherein the recovery unit is positioned at a home position on the right-hand side in this example.

In the recovery unit, 300 is a cap unit provided corresponding to each of a plurality of cartridges C having a head unit 100, which cap unit is slidable in the right and left directions in the figure along with the movement of the carriage 2, as well as being raised or lowered in the vertical direction. And when the carriage 2 is placed at the home position, the cap unit engages and caps a discharge portion 101 of the head unit. The constitution of the cap unit 300 will be described later in connection with FIG. 4.

Also, in the recovery unit, 401 is a blade serving as the wiping member, and 403 is a blade cleaner made of an absorbing material, for example, for making the cleaning more complete. In this example, the blade 401 is carried by a blade lifting mechanism to be driven with the movement of the carriage 2, and can be set at a position where the blade is protruded (raised) for wiping and cleaning a discharge port formation face portion, or at a position where it is retracted (lowered) so as not to interfere with the discharge port formation face portion. In this example, when the carriage 2 is moved from the right to left side in the figure, the cleaning is performed with the wiping of the blade. The lifting mechanism for the blade 401 will be described later in connection with FIG. 2. Note that if there is any portion above the discharge port formation face of the head unit 100 which is not wiped by the blade 401, an auxiliary blade (indicated by the numeral 402 in FIG. 3) may be provided at a position of wiping that portion.

Further, in the recovery unit, 500 is a pump unit leading to the cap unit 300, which is used to produce a negative pressure in the suction process which is effected by joining the cap unit 300 with the head unit 100.

Figure 4:
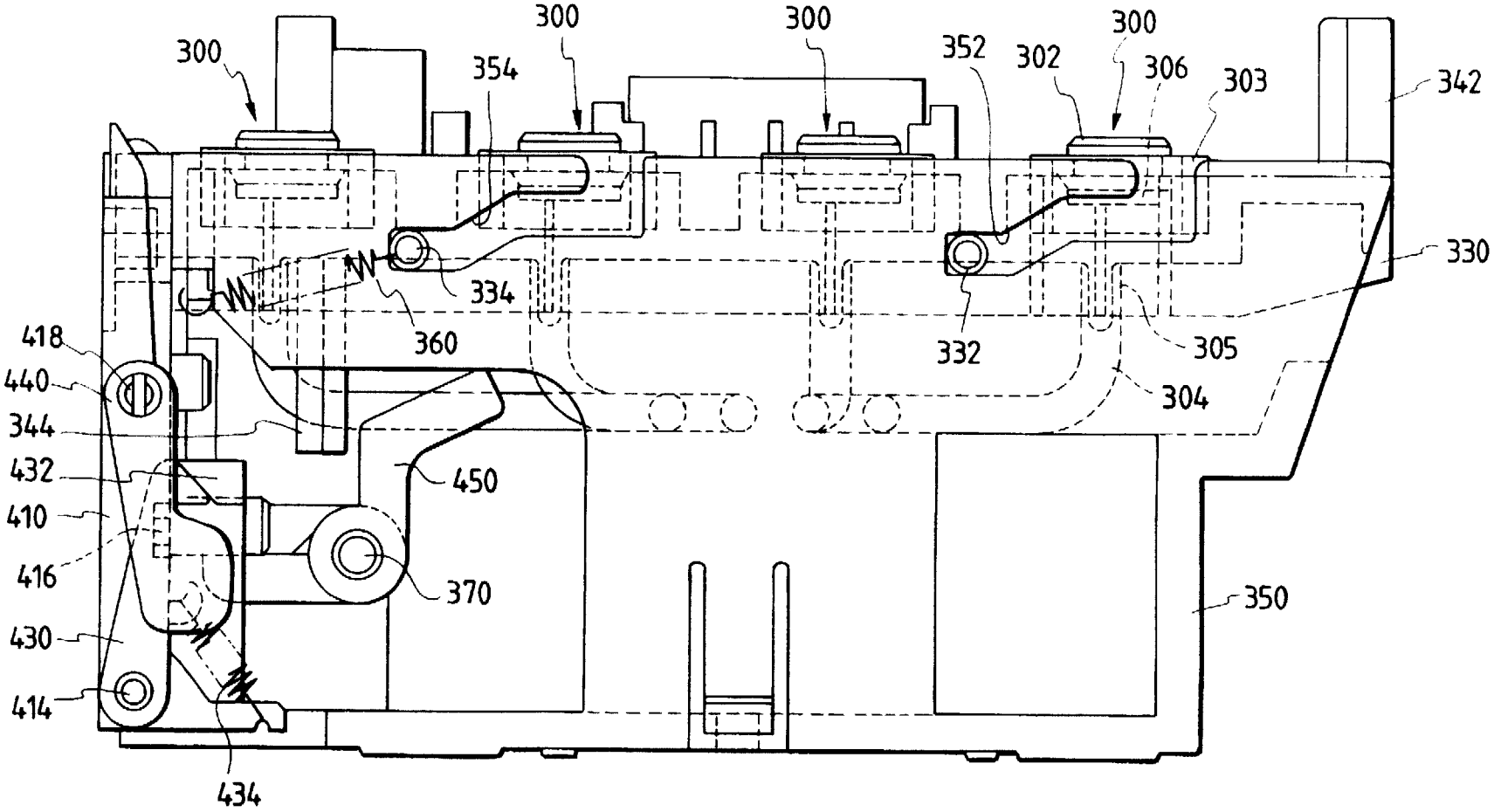
FIG. 4 is an elevational view showing a detailed constitutional example of a recovery unit.

FIG. 4 is an elevational view showing a detailed constitutional example of the recovery unit. Such a recovery unit may be one as disclosed in Japanese Laid-Open Patent Application No. 3-73352 (convention application based on Japanese Patent Application No. 1-122878) proposed by the present applicant, and its constitution will be briefly described below.

First, the cap unit 300 has a cap 302 enclosing the discharge port of the head unit 100, a holder for holding the cap, an absorbing member for receiving the ink in an idle discharge process and a suction process, a suction tube 304 for sucking the ink to be received, and a connection tube 305 communicating to the pump unit 500. The cap unit 300 is provided at a position corresponding to a respective cartridge C by the same number as that of cartridges (four in this example), and supported by the cap holder 330.

332 and 334 are pins projected from the cap holder 330, each pin engaging a respective one of cam grooves 352 and 354 provided in a recovery unit base 350 for guiding the cap holder 330 in the left or right direction, and in the upper or lower direction, as shown. A spring is tensioned between one pin 334 of the cap holder 330 and a start-up portion of the recovery unit base 350, thereby urging the cap holder 330 toward a position as shown in the figure, that is, the cap holder may be held at a left end lowered position. Note that with the cap holder 330 or cap unit 300 being placed at this position, the head unit 100 of the cartridge C mounted on the carriage 2 is opposed to a start position of the carriage 2 in recording for one scan.

342 is an engaging portion for engaging the carriage 2 at a position rightward of the start position, which is started up by the cap holder 330. If the carriage 2 is moved further rightward in the figure, the cap holder 330 is moved with the engaging portion 342 against an urging force of the spring 360. Then the cap holder 330 is guided via the pins 332 and 334 along the cam grooves 352 and 354 to be displaced right and upward. Therefore, the cap 302 is brought into close contact with the discharge port face for the capping. Note that the position of the carriage 2 for the capping is a recovery position.

Note that the cap 302 is made of an elastic material, including a securing portion for the connection to the holder 303, and an edge portion for extending a tubular structure from the securing portion, which are integrally molded. The cap 302 can be formed of an elastic material such as silicone rubber or butyl rubber.

Next, the lifting mechanism for the blade 401 will be described.

Referring to FIG. 4, 410 is a liftable blade holder, on an upper portion of which a blade 401 is attached with an appropriate fixture. The blade holder 410 is urged toward a lower position by a holder returning spring.

430 is a lock lever, rotatable around the pin 414 projected from the blade holder 410, for locking the blade holder 410 at a raised position by engagement with an upper face of a stopper 432, this lock lever being urged in a clockwise direction in the figure by the spring 434. Also, in the state as shown, it engages a portion 416 projected from the blade holder 410 and is held at the position as shown.

440 is a release lever, rotatable around the pin 418 projected from the blade holder 410, for releasing the lock state of the lock lever 430 when the blade holder 410 is at the raised position, wherein the lock is released by rotating it around the pin 418 in the clockwise direction as shown. That is, the release lever 440 has pin (not shown) erected, which is engageable with the lock lever 430, in which if the release lever 440 is rotated around the pin 418 in the clockwise direction in the figure, the pin 442 causes the lock lever 430 to be rotated around the pin 414, releasing the engagement between the lock lever 430 and the upper face of the stopper 432.

450 is a cam member for transmitting the driving force to raise the blade holder 410 with the movement of the carriage 2, which is rotatably held around the pin 370 projected from the recovery unit base 350.

With the above mechanism, the blade 401 is raised with a slide of the cap unit 300 by the displacement of the carriage 2 in a right direction as shown, and then caused to perform the wiping with the leftward movement of the carriage 2 after the suction recovery using the pump unit 500. In this example, the ink wiped and received by the blade 401 is absorbed into an absorbing member provided on the head unit, and a further absorbing member on the carriage, causing no problems such as the color mixture between heads, except that some of the ink may flow down along a surface of the blade 401. This can be cleaned in the following manner.

When the carriage 2 is moved from the left, the blade 401 is lowered. The blade cleaner 403 is in contact with the blade 401, because the cap unit 300 has already returned to its original position with the blade cleaner 403 attached to the cap unit 300. Therefore, when the blade 401 is lowered, the ink adhering to its surface is all received into the cleaner 403 in the form of absorbing member, whereby the blade 401 can be wiped surely.

Note that a blade portion engageable with the discharge port formation face is cleaned with the absorbing member on the head unit side as will be described next and the absorbing member on the carriage side, so that a part any portion of the ink possibly adhering will have no effect on the color mixture between heads. Further, if the cleaning is completely performed with the absorbing member on the head unit side and the absorbing member on the carriage side, the cleaner 403 may not be necessarily provided.

In the above example, the recovery unit has a mechanism for lifting the cap and the blade in mechanical engagement with the carriage and with the movement thereof, but another means for lifting them may be provided, rather than the mechanical engagement as above.

(3) Blade cleaning (3.1) Action of absorbing member 104

The head unit 100 in FIG. 1 is provided with an absorbing member 104 as the first absorbing member adjacent to the discharge port formation face. In this example, when the carriage 2 placed at a cap position is moved leftward in the figure, the discharge port formation face of one head is wiped with the blade 401, and the absorbing member 104 provided on the same head engages and cleans the blade 401, whereby it is possible to avoid disadvantages such as the color mixture with the next head, a phenomenon that the wiped ink is swept onto the ink discharge face or flows around the head and the carriage, or the pollution in exchanging the head cartridge. The detail and action for this absorbing member will be described below.

Figure 5:
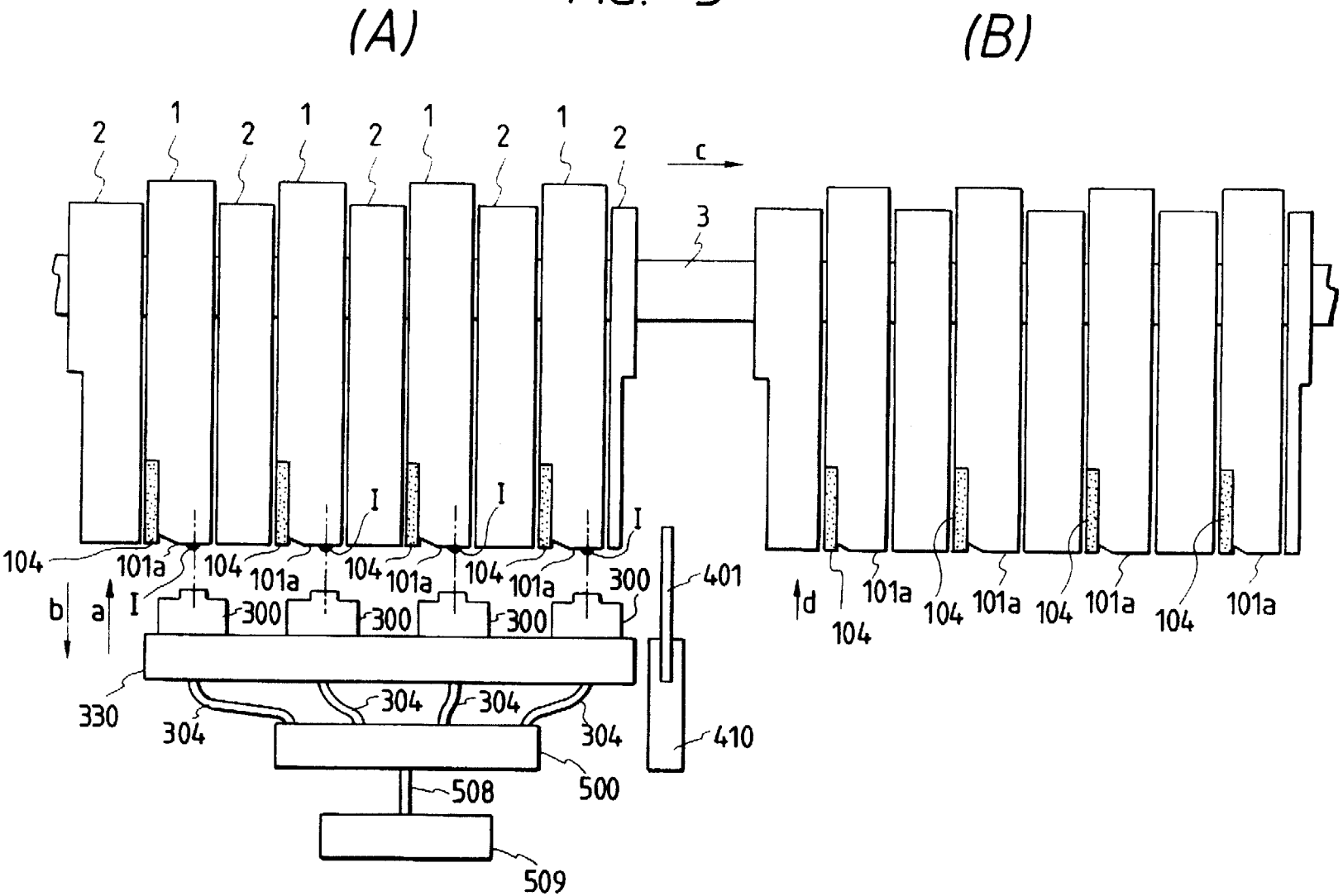
FIG. 5 is an explanation view for explaining the wiping and blade cleaning operation for a head unit of the head cartridge in one example.
Figure 6:
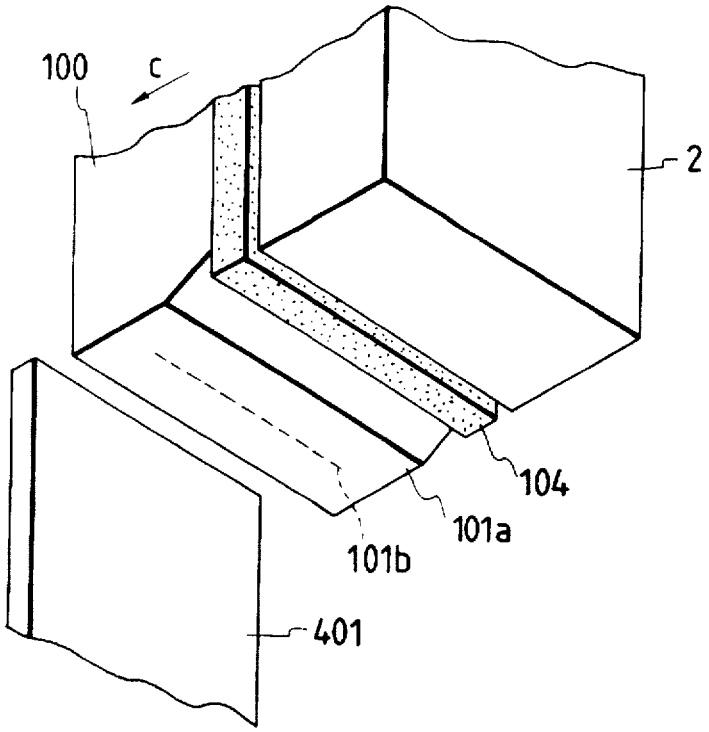
FIG. 6 is a typical perspective view for explaining the same operation.

FIGS. 5 and 6 are a cross-sectional view and an enlarged perspective view of the recovery unit in this example, as seen from the front side (reverse side of FIG. 3).

The head unit 100 is secured to the carriage 2, as above described, which is carried on a main scan rail 11, and attached movably in a print direction (direction of arrow C). For example, if the discharge port **101*b* of the head unit 100 becomes clogged, a holder 330 having caps 300 forming a closed space in the head at the non-print position ((A) state in FIG. 5) is moved in a direction of arrow a, so that the caps 303 are brought into contact with the discharge faces 101*a* and stopped at the position where the closed system is created. In this state, the suction recovery is performed via tubes 304 with a pump unit 500. The ink pulled out from the head unit 100 due to the suction is transported via a tube 508 into a waste ink processing member 509. After the suction recovery, the holder 330 having the caps 300 is retracted in the direction of arrow b. At this time, the ink I pulled out from the discharge port 101*b* with the suction recovery may remain on the discharge face 101*a* of the head unit 100. The carriage 2 ((A) state) is moved in the direction of arrow c, and the wiping for the discharge face 101*a* is performed with the blade 401 carried by the blade holder 410 ((B) state in FIG. 5), whereby the ink I on the discharge face 101*a* is removed from the discharge face 101*a***.

On the downstream side of wiping for the head unit 100, the absorbing member 104 is secured one onto each head of the head unit 100 by means of adhesion or thermal caulking. In the head constitution, a taper portion is formed adjacent to the absorbing member 104 on the portion of the discharge face **101*a* upstream of wiping with the absorbing member 104**, whereby an edge portion of the absorbing member is protruded therefrom.

The material of the absorbing member 104 is a porous material of polyolefine having a property of swelling little in absorbing the liquid (e.g., a porous sintered compact of polyethylene treated for the hydrophilization, having a swelling rate of 0.01 to 0.02%. Trade name: Sunfine AQ, made by Asahi Chemical Industry Co., Ltd.)

Figure 7A:
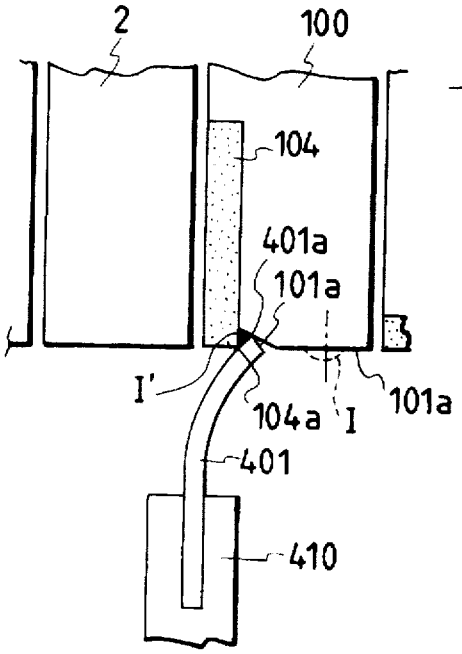
FIGS. 7A and 7B are partial enlarged views of FIG. 6 for explaining the same operation.
Figure 7B:
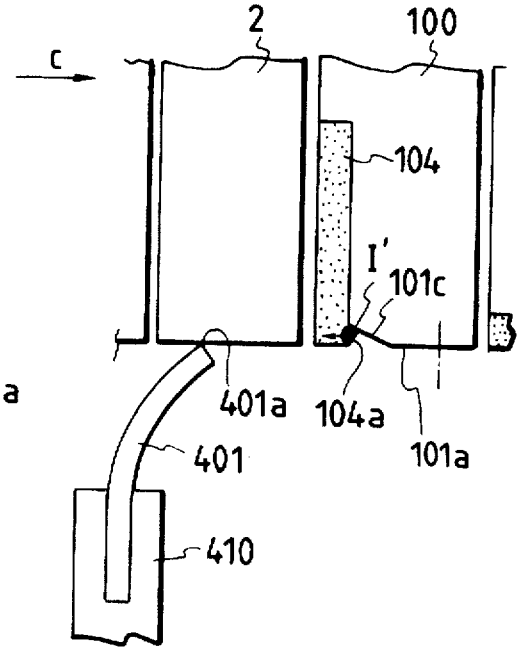

The behavior of ink droplets in wiping will be described below with reference to FIGS. 7A and 7B.

FIG. 7 is a view enlarging the discharge face portion as shown in FIG. 5. The adhering ink I to the discharge face **101*a* with the suction recovery is removed from the discharge face 101*a* by the blade 401, with the movement of the carriage 2 in the direction of arrow c, and moved on a portion of the discharge face 101***a* along with the blade 401 so as to be scraped off from the blade 401 when coming into contact with an edge 104*a* of the absorbing member 104 on the head side at the taper portion 101*c* formed on the discharge face 101*a*, with the ink being once reserved in the taper portion 101*c*. Then the ink I' is immediately absorbed into the absorbing member 104 (I' state of (a)) And the carriage 2 is further moved in the direction of arrow c, whereby the ink completely removed from the edge 401*a* of the blade 401 when the blade 401 arrives at the next head ((b) state). Hence, the ink removed from the discharge face 101*a* has no effect on the next head, causing no disadvantages such as the color mixture, so that the wiping is enabled in the state where the blade 401 has always a clean edge 401*a*.

The adhering ink to the blade 401 can be excellently removed by providing the absorbing member in the region adjacent to the head.

In this example, the ICs for storing the information are mounted on the side of a recording head substrate as in the example previously described. The ICs may be destroyed if the ink scattered with the cleaning operation sticks to them.

Accordingly, it is preferable to provide the absorbing member on the substrate side where the ICs are disposed.

It is more preferable that the ICs are provided on the substrate side located downstream of the head discharge port in the cleaning direction, in cooperation with the blade cleaning effect as previously described.

When the absorbing member is provided on the reverse side of the ICs as in this example, the ICs will not be broken with the scattering of the ink because the blade can pass through a side face having the ICs before the head cleaning in cleaning a plurality of heads in sequence.

Figure 8:
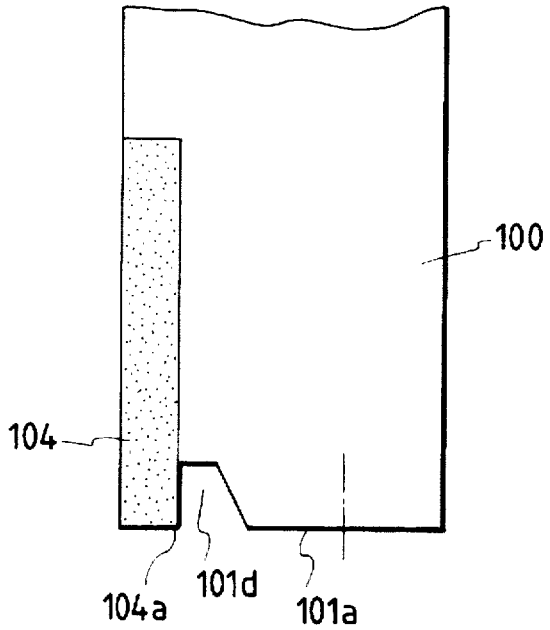
FIG. 8 is an explanation view showing another constitutional example of a head unit wiped portion and a blade cleaning portion.

In this example, the head unit 100 is constituted to have the taper portion 101*c* of the discharge face 101*a* adjacent to the absorbing member 104, but the same effects can be obtained if a groove portion 101*d* may be formed on the discharge face 101*a* adjacent to the absorbing member 104 as shown in FIG. 8.

Figure 9:
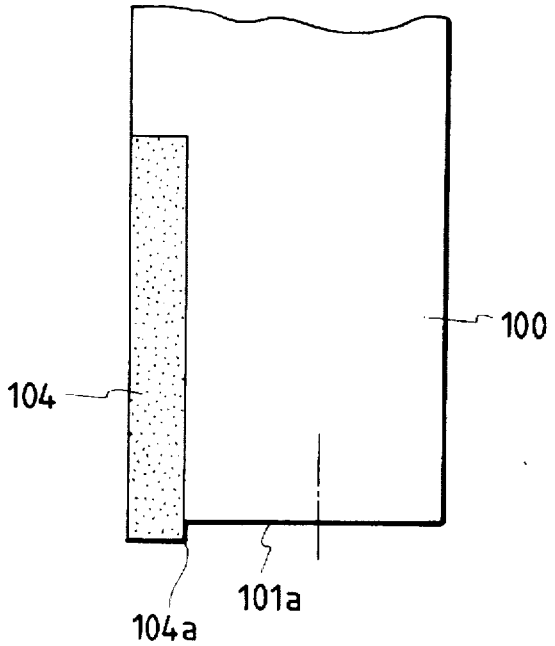
FIG. 9 is an explanation view showing a further constitutional example.

The absorbing member 104 may be protruded from the discharge face 101*a* as shown in FIG. 9, rather than forming a recessed portion in the discharge face. That is, the discharge face 101*a* adjacent to the absorbing member 104 and located upstream of the absorbing member 104 in the wiping direction is recessed from the absorbing member 104, which means that the same effects can be obtained if the edge portion 104 of the absorbing member 104 protrudes. Further, a combination of both may be used.

Figure 18:
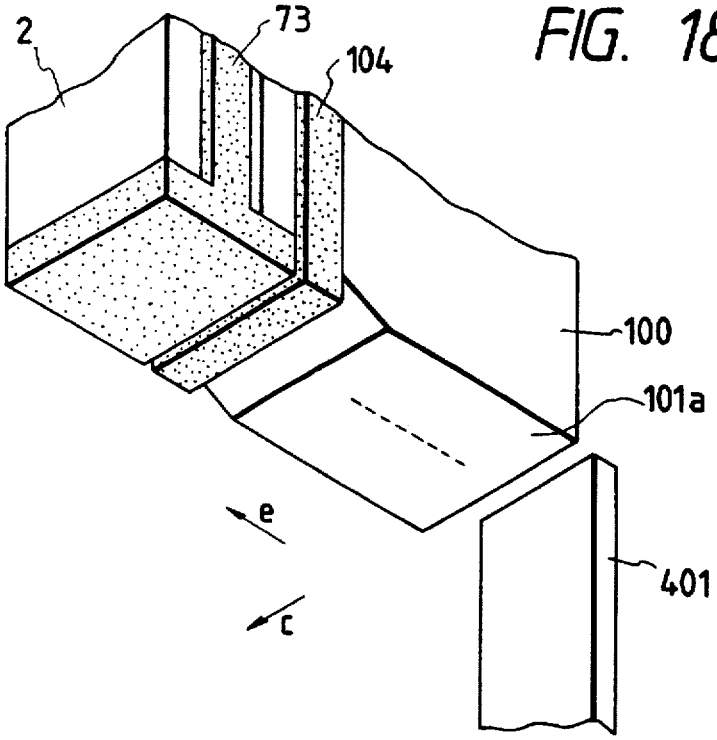
FIG. 18 is a typical perspective view for explaining a head cartridge having the constitution different in the carriage moving direction and the wiping direction.

Further, in the example, the wiping is made in the main scan direction (print direction), but the same effects as in this example can be obtained if the wiping is made in the vertical direction to the main scan direction. This will be described later in connection with FIG. 18.

The blade cleaning absorbing member 3 may be disposed with a step at a position slightly recessed from the discharge port face of the recording head protruding downward of the carriage 2.

The ink jet recording apparatus may produce white streaks or dark streaks in the image if the position accuracy of discharged ink droplets impinging onto a recording medium P is bad. One of the measures for preventing such an image degradation is to make smaller the spacing between the discharge port face 1 of the recording head and the recording medium P so as to have a smaller impining error of ink droplets, thereby improving the image quality. However, when the ink is discharged onto the recording medium P, there occurs a great difference of water content between a face of the recording medium P onto which the ink is discharged and its back face, or between a portion where the ink is discharged and a portion where the ink is not discharged and this difference of water content will produce a difference of swelling rate, causing some irregularities called as the cocking on the recording medium P. Thereby if the spacing between them is too small, a problem arises that the recording head and the recording medium P may be placed into contact, dirtying the recording face. Accordingly, it is preferable to set the distance between the recording head and the recording medium P as small as possible in a range where they are not scraped with the cocking. Accordingly, the blade cleaning absorbing member 3 disposed on a bottom portion of the carriage 2 can be provided flush with the recording head protruding downward of the carriage 2, or spaced farther away from the recording medium than from the recording head. In particular, the blade cleaning absorbing member 3 is quite likely to pollute the recording medium P because of having a quantity of absorbed ink, and is thus preferably disposed at a position recessed about 0.5 mm from the recording head for the purpose of assuring safety.

(3.2) Dimensions of absorbing member

Here, the constitution of the absorbing member will be described below.

First, with the above constitution, the amount of ink to be transferred from the head unit 100 to the absorbing member 104 with the cleaning operation will be described.

The ink jet head of this example has 128 discharge ports, and an image density of 40 dpi. The ink is supplied from the ink tank unit 200 formed integrally with the head unit 100 as above described. Here, the weight of ink received in the ink tank unit 200 is 60 g, and the specific gravity of ink is 1.05. The usable ink weight for the print is 40 to 50 g. The residual amount of ink serves to inform the operator of the time for exchanging the ink cartridge immediately before the stable discharge of ink is disabled in such a manner as to dispose an electrode pin for detecting the residual amount of ink within the ink tank as above described, and detect the change of resistance between electrodes with decreased ink.

The printable number of sheets with the ink tank unit will be described.

The normal print duty which is most frequently used is 10% to 30% per head, and assuming the weight of ink within the ink tank to be 60 g (with a usable weight of 40 g to 50 g), the printable number of sheets is estimated to be from 300 to 1000 sheets. For this estimation, the consumption amount of ink includes the ink to be used for the print, the ink to be used for the suction recovery, and the ink to be used in performing the operation called as an idle discharge or predischarge of effecting a certain number of discharges through all discharge ports before or after the print, or during the print (after printing one line and before printing next one line) for the purpose of holding the discharge state of each nozzle steady, and after the cleaning operation with the blade 401, and the printable number of 300 to 1000 sheets as previously cited was obtained by an effective value measured in a print mode or recovery mode as will be described later.

The amount of ink to be transferred from the head unit to the absorbing member 104 with the cleaning operation of the blade 401 will be described below.

The cleaning operation of the blade 401 is largely classified into two types:

(i) Cleaning the ink remaining on the head surface in the suction recovery (ii) Cleaning the ink adhering to the head surface with the print.

First, the amount of ink for the type (i) of cleaning the ink remaining on the head surface in the suction recovery will be described. The ink remaining on the head surface with one time of suction recovery operation amounts to 0.0003 g to 0.0015 g, including the ink remaining on the discharge port and the ink (cap trace ink) remaining on a portion (cap trace) of the head unit 100 contacted by the cap 300. This value was obtained from experimental values under the condition where the gap between the discharge face 101*a* and the absorbing member is 0.2 to 1 mm at the capping (suction), by treating the head surface (discharge face 101*a* and cap contact portion) and the cap 300 around the head contact portion with the water repellent, and disposing the absorbing member (not shown) within the cap 300.

The sequence of suction recovery may be set such that one suction recovery is made every time a predetermined number of sheets (e.g., ten sheets) is printed. This is to prevent beforehand a phenomenon of producing bubbles within a liquid chamber of the head in the printing so as to block the liquid chamber with the growth of bubbles and cause the undischarge, with the suction recovery for every 10 sheets of print.

Figure 10:
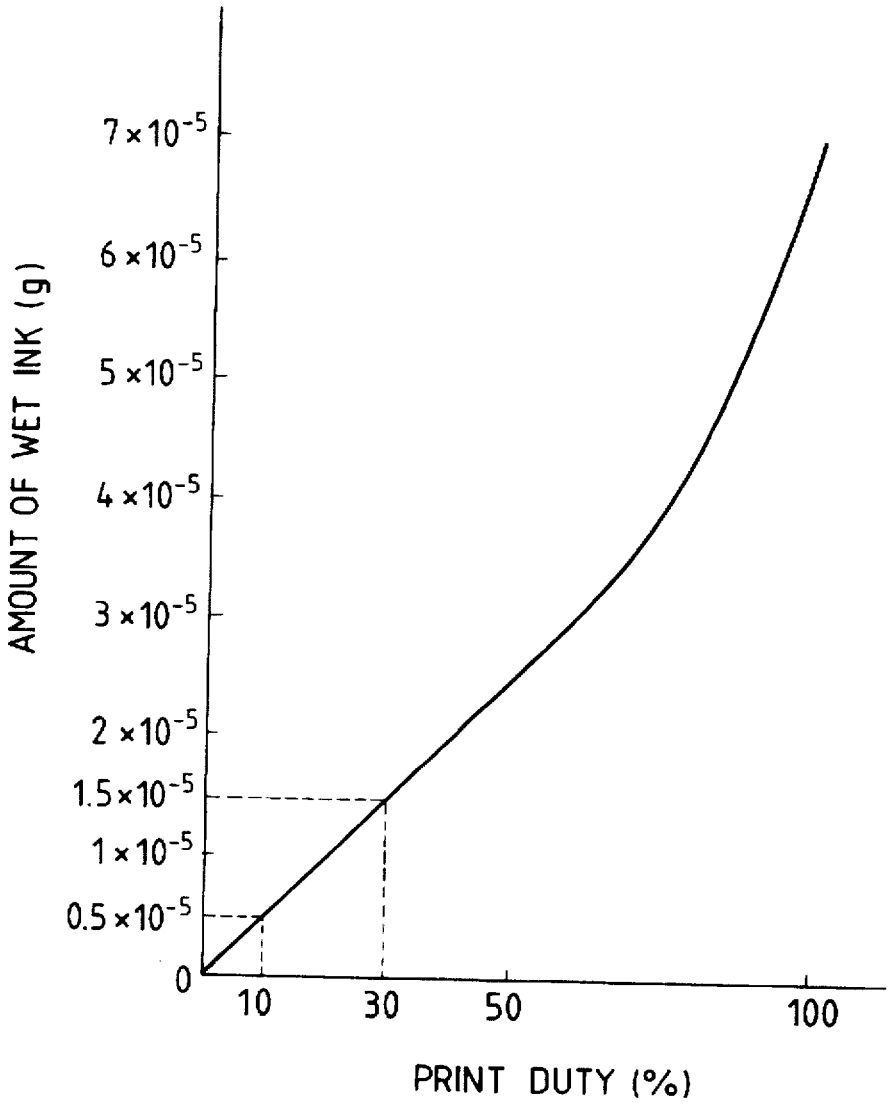
FIG. 10 is an explanation diagram showing the relation between the print duty and the amount of wet ink, which is one factor for determining the dimensions of an absorbing member provided on the head unit.

Hence, estimating the amount of ink to be transferred into the head absorbing member in the above sequence, the maximum is 0.0015 g (MAX value of residual ink)×100 times (=print number of sheets 100 sheets/10 sheets)=0.15 g the minimum is 0.0003 g (MIN value of residual ink)×30 times (=print number of sheets 300 sheets/10 sheets)=0.009 g Next, the amount of ink in cleaning the adhering ink to the head surface with the print in (b) will be described. The amount of adhering ink (called as the wet ink) to the head surface with the print depends on the print duty, in which the amount of wet ink is less with a lower print duty, and increases gradually with higher duty, tending to increase up to about 70 to 100% of the print duty, as shown in FIG. 10. The amount of wet ink in printing one sheet of A4 size is $0.5\times10^{-5}$ g for a print duty of 10%, and $1.5\times10^{-5}$ g for a print duty of 30%.

The amount of wet ink varies with the gap between the discharge face 101*a* and the recording sheet (sheet gap), and tends to increase with a narrower gap. Also, the amount of wet ink increases in proportion to the number of discharge ports. FIG. 10 shows the value with 128 nozzles.

Assuming a sequence of cleaning once after the printing of one sheet, the amount of ink to be transferred to the absorbing member 104, the maximum is $1.5\times10^{-5}$ g (wet ink amount for a print duty of 30%)×1000 times=0.015 g the minimum is 0.5×10 g (wet ink amount for a print duty of 10%)×300 times=0.0015 g On the basis of the result from (i) and (ii), the amount of ink to be transferred into the absorbing member 104 with the cleaning is estimated such that the maximum is 0.15 g (maximum value of (i))+0.015 g (maximum value of (ii))=0.165 g the minimum is 0.009 g (minimum vlaue of (i))+0.0015 g (minimum value of (ii))=0.0105 g As a result of the above calculation, it follows that the absorbing member of the head must hold the maximum amount of ink of 0.165 g or more.

The constitution of the absorbing member 104 will be described below.

The material may be arbitrary if it can accomplish the ink absorption as previously described, and may have the swelling nature. However, the material of unswelling nature is preferred from the standpoint of smaller apparatus and no dripping of absorbed ink. That is, a porous sintered compact of polyolefine treated for the hydrophilization (trade name: Sunfine AQ, made by Asahi Chemical Industry Co., Ltd.) as previously described having a very small swelling rate of 0.01% to 0.02% is preferable. Hence, as the volume of absorbing member hardly changes even if it absorbs the ink, there is a merit that the absorbing member can be used on a portion of strict precision. That is, because of being mounted on the head in this example, the absorbing member is effective to assure the gap relative to the main scan carriage 2 in mounting or demounting the head cartridge, or raise the accuracy of gap between the absorbing member 104 and the recording sheet. Accordingly, the material having the swelling nature can be also used, but due to a very small space for the region of disposing the absorbing member, there is a fear that the ink may leak with its swelling in this region, whereby in this respect, the unswelling material is more preferable. The liquid absorption rate of such an absorbing material is 35% to 50%.

Next, the evaporation of ink will be described. The evaporation of ink depends on the environment. It is large in a low humidity environment (e.g., a humidity of 10% or less), so that all evaporable components of the ink will evaporate. However, in a higher humidity environment (e.g., a humidity of 80% or more), the evaporation speed is slower, and the evaporation is less. In the practical use, the dimensions of the absorbing member must be determined based on the evaporation under high humidity environment. In this example, 80% of the ink will evaporate and 20% will remain in the low humidity environment, while 30% of the ink will evaporate and 70% will remain in the high humidity environment.

The dimensions of the absorbing member 104 are set on the basis of the above conditions.

The following relation will stand between the volume of the absorbing member 104 and the amount of ink to be passed from the head unit 100 to the absorbing member 104.

Volume of head absorbing member: A[$cm^3$]

Absorptivity of head absorbing member: B

Specific gravity of ink: C[g/cm ] (1.0 to 1.1)

Amount of ink passed from head to head absorbing member: i[g]

Proportion of residual ink after evaporation: D $$ABC>iD \quad (1)$$

$$A>iD/BC \quad (2)$$

The volume A of head absorbing member is obtained from the expression (2).

(a) When A is largest i=maximum value of A+B=0.165 g, D=value under high humidity=0.7, B=minimum value=0.35, C=minimum specific gravity of ink=1.00, $$A = (0.165\times0.7)/(0.35\times1.00) = 0.33\ [cm^3]$$

(b) When A is smallest i=minimum value of A+B=0.0105 g, D=value under low humidity=0.2, B=maximum value=0.5, C=maximum specific gravity of ink=1.1, $$A = (0.0105 \times 0.2)/(0.5 \times 1.1) = 0.004\ [cm^3]$$

(c) Minimum required volume A in this example i=maximum value of A+B=0.165 g, D=value under high humidity=0.7, B=0.35, C=1.05, $$A = (0.165 \times 0.7)/(0.35 \times 1.05) = 0.31\ [cm^3]$$

Assuming that the ink capacity of the ink cartridge is I[g]=60[g] (the printable amount of ink is 40 to 50 g), the following relation will stand with the volume A of the head absorbing member.

(a) A/I>0.33/60=11/2000

(b) A/I>0.004/60=1/15000

(c) A/I>0.31/60≅1/200

That is, it is sufficient that the volume A of the head absorbing member has 1/15000 or more the ink capacity I in the best condition, and 11/2000 or more in the worst condition.

The volume of head absorbing member in the example is 0.34 to 0.4 [$cm^3$], which satisfies the condition more fully than minimum required volume of 0.31 [$cm^3$] in (c) in this example.

Next, the factor of determining the maximum value of volume A for the absorbing member will be described below. First, the maximum amount of the ink in cleaning the residual ink on the head surface with the suction recovery of (i) as above is estimated. The suction recovery is performed once per sheet. Therefore, the amount of ink is 0.0015 g (MAX value of residual ink)×1000 times=1.5 g Further, by adding the mode of performing the suction recovery with an instruction by the operator, when the suction is performed once per sheet, the amount of ink is 0.0015 g (MAX value of residual ink)×1000 times=1.5 g Hence, the worst value in the case of (i) is 1.5 g+1.5 g=3 g Next, the maximum value of cleaning the adhering ink to the head surface with the print in (ii) is estimated. If the print is made with a print duty of 100%, the amount of ink is $7\times10^{-5}$ g (wet amount with a print duty of 100%)×1000 times=0.07 g from FIG. 10.

The maximum value of ink weight i to be passed into the absorbing member is (i)+(ii)=3 g+0.07 g=3.07 g Calculating the volume A of the head absorbing member from this value, from i=3.07 g, D=0.7, B=0.35, and C=1.00, $$A = (3.07 \times 0.7)/(0.35 \times 1.00) = 6.14\ [cm^3]$$

A/I=6.14/60≅1/6

Hence, the volume A of the absorbing member is desirably 6.14 g or more, for which the relation such that A/I is 1/6 or greater must hold. In the practical design, in view of safety factor, it is desirable to set the volume to be about twice the above set value. That is, $$6.14\times2=12.28\ [cm^3]$$

$$A/I=12.28/60\cong1/5$$

whereby there is no functional problem if A/I is set to be 1/5 or greater.

However, since the space around the head is limited, with the cost increasing with larger volume of the absorbing member itself, it is most preferable that the volume is at minimum value in the range of causing no functional problem, with the upper limit of A being A/I=1/5.

If the volume A of the head absorbing member and the printable ink weight I* of ink cartridge are considered, the following relation will stand, maximum value A/I*<12.28/40≅3/10 minimum value A/I*>0.004/50=1/12500

In this example, the dimensions of the head absorbing member are the same through four heads, but if the above condition is satisfied, the dimensions of the absorbing member may be changed for each head. This is because the amount of adhering ink to the discharge face 101*a* during the print may vary depending on the head position. If the print is made in the direction of arrow C as shown in FIG. 5, the amount of adhering ink to the head discharge face 101*a* with the print may increase in the order of head array in the print direction. This is because more downstream in the print direction, the density of fine ink droplets floating in the space around the head will increase during the print, whereby there occurs a phenomenon that a greater amount of ink will adhere to the discharge face of the head located on more downstream side. Hence, in accordance with this behavior, the dimensions of the head absorbing member can be determined to be different for each head in a range of satisfying the above condition.

(3.3) Another example of disposing the absorbing member

In the above example, the absorbing member 104 is provided on the head unit 100 so as to avoid disadvantages such as the color mixture, but another example of offering further effects will be described below.

Figure 11:
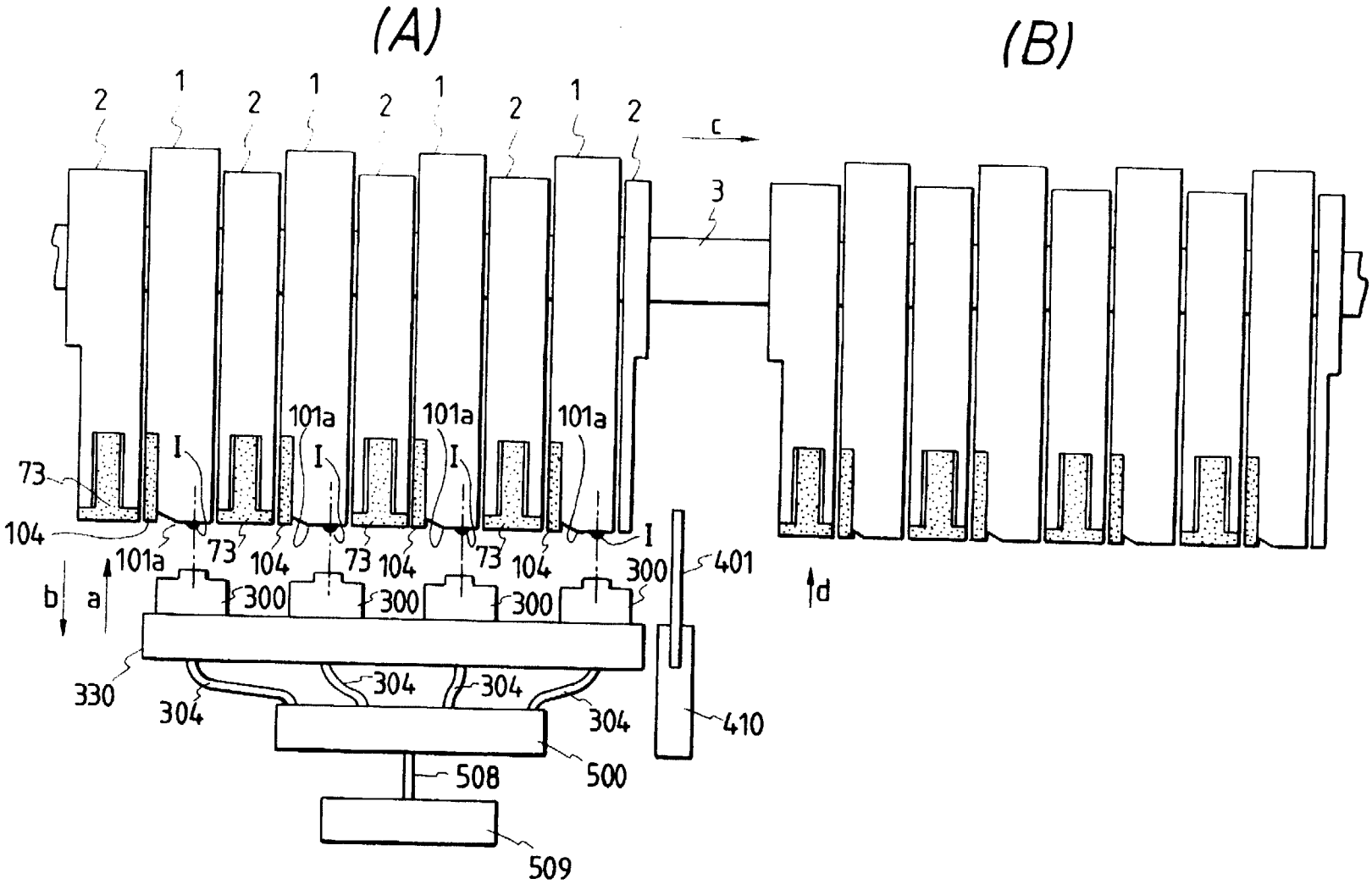
FIG. 11 is an explanation view for explaining the wiping and blade cleaning operation for a head unit of a head cartridge in another example of the present invention.
Figure 12:
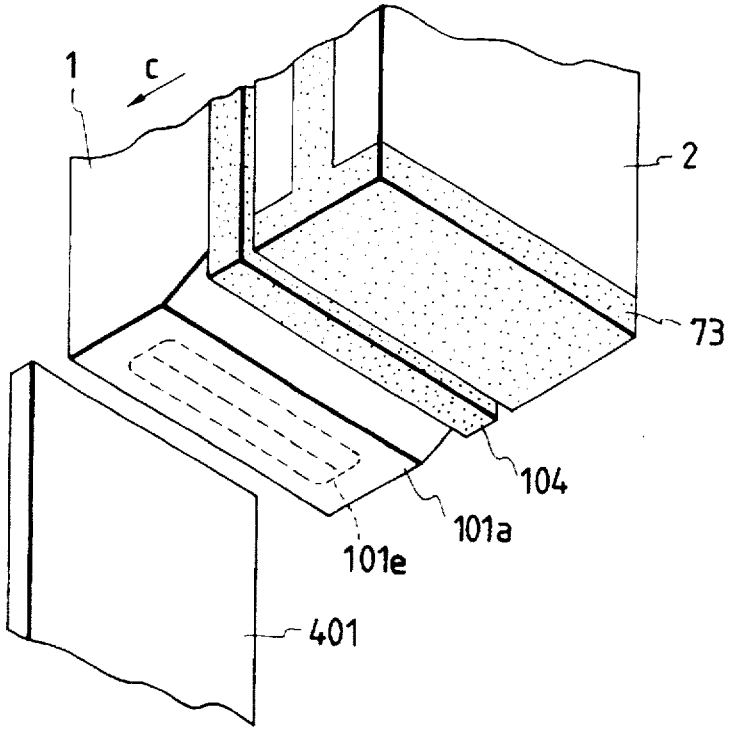
FIG. 12 is a typical perspective view for explaining the same operation.

FIGS. 11 and 12 are a cross-sectional view and an enlarged perspective view of the recovery unit in this example, seen from the front side, respectively, wherein like numerals are attached to like parts which are constituted in the same way as in FIGS. 5 and 6.

While in this example, the wiping is performed in the process of the carriage movement from state A to state B in the c direction, as shown in FIG. 11, so as to clean the blade 401 with the absorbing member 104, the ink possibly remaining on the blade 401 is absorbed by an absorbing member 73 as the second absorbing member provided on the carriage 2 so as to make a more complete cleaning of the blade 401. Note that the absorbing member 73 can be made of the same material as for the absorbing member 104, and can be disposed in the same securing manner.

Figure 13A:
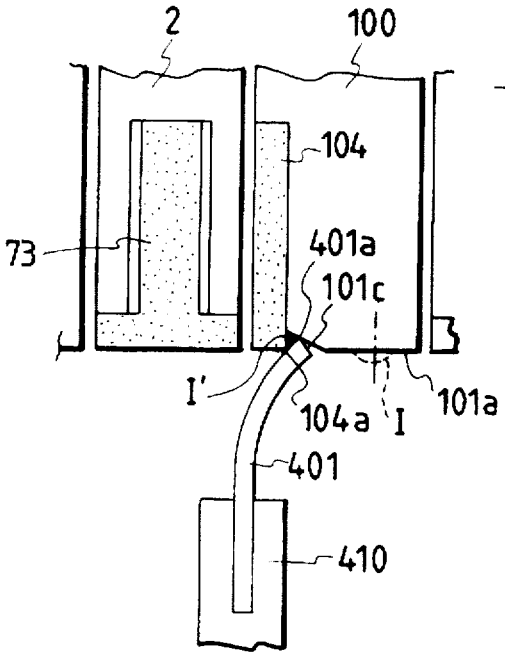
FIGS. 13A and 13B are partial enlarged views of FIG. 11 for explaining the same operation.
Figure 13B:
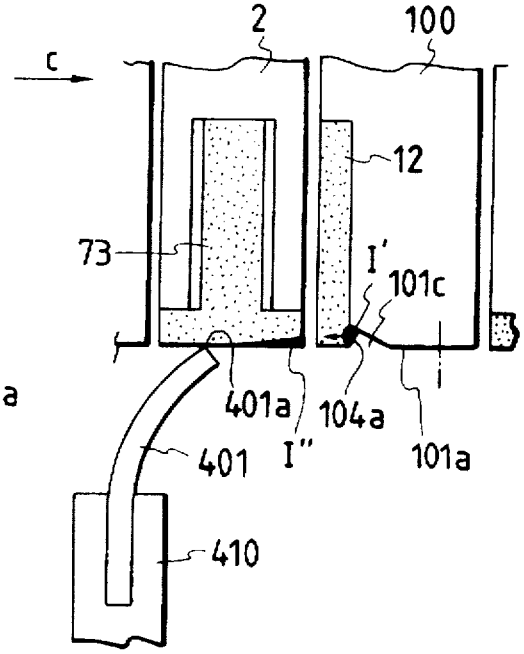

The operation of this example will be described with reference to FIG. 13.

The adhering ink I to the discharge face 101*a* with the suction recovery is removed from the discharge face 101*a* by the blade 401, with the movement of the carriage 2 in the direction of arrow c, and moved on the discharge face 101*a* along with the blade 401 so as to be scraped off from the blade 401 when coming into contact with an edge 104*a* of the absorbing member 104 for the head at a taper portion 101*c* formed in the discharge face 101*a*, with the ink being once reserved in the taper portion 101*c*. Then the ink I' is immediately absorbed into the absorbing member 104 (I' state of (a)). And if the carriage 2 is further moved in the direction of arrow c, the blade 401 is moved while rubbing with the absorbing member 73 of the carriage. Then the blade 401 is moved while a slight amount of ink I" not removed by the head absorbing member 104 is absorbed into the absorbing member 73, whereby the ink is completely removed from the edge 401*a* of the blade 401 when the blade 401 arrives at the next head ((b) state). Hence, the ink removed from the discharge face 101*a* has no effect on the next head, causing no troubles such as the color mixture, so that it is possible to make the wiping in the state where the edge 401*a* of the blade 401 is always clean.

Note that the absorbing member 73 on the carriage side should be as great as possible in a limited space, because it can not be easily exchanged though the head absorbing member 104 can be exchanged integrally with the head. In other words, since the absorbing member on the head side can be periodically refreshed, it suffices to be smaller by improving durability of the absorbing member 73 on the carriage side which is difficult to exchange, so that it is possible to realize a smaller cartridge and apparatus, with a reduced cost.

The desirable relation of the dimensions for the absorbing members 104, 73 in this example is as follows.

Figure 14:
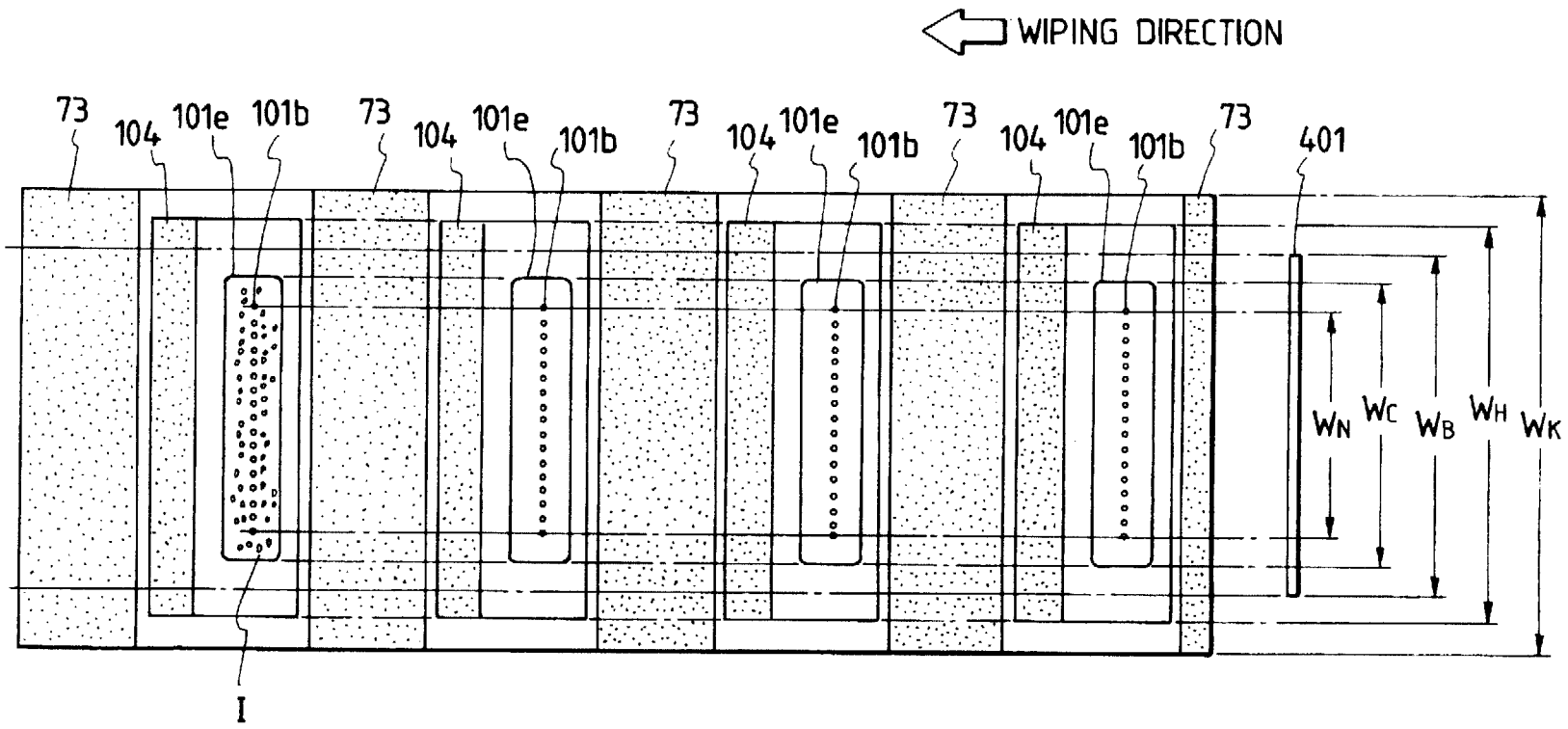
FIG. 14 is an explanation view for explaining the relation between the range of ink discharge port array, the cap width, the blade width, the width of head side absorbing member and the width of carriage side absorbing member in the example.

FIG. 14 is an explanation view for explaining the relation of the dimensions for each portion, WN indicating the width of range for the array of discharge ports 101*b* (including the so-called dummy nozzle). WC is the width of the range 101*e* to be covered by the cap 300, in which WN<WC as the group of discharge ports 101*b* should be located within the space formed by the cap 300. Further, WB is the width of the blade 401, in which it is greatly desirable that the range 101*e* can be wiped completely, considering that the ink droplets I may often remain within the range 101*e*, and accordingly, WC<WB. WH is the width of absorbing member 104 provided on the head unit 100, in which WB≦WH as it cleans the blade 401 in contact therewith. Note that the above relation will stand in the example as shown in FIGS. 5 and 6.

WK is the width of the absorbing member 73 provided on the carriage in this example, in which WH≦WK, considering that the ink not absorbed in the process of cleaning the blade 401 with the absorbing member 104 may possibly spread outward. That is, in this example, the dimensions of each portion are determined so that the relation of WN<WC<WB≦WH≦WK may stand.

Figure 15:
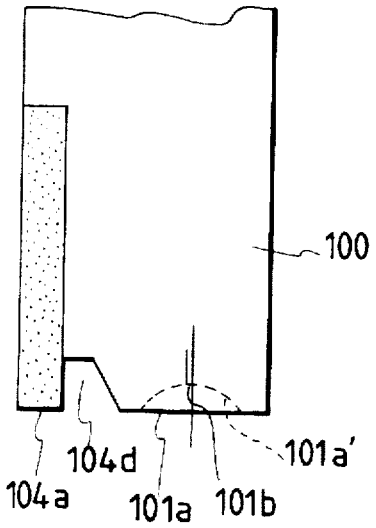
FIG. 15 is an explanation view showing the head unit in which an ink discharge port array face is concave as the variation of FIG. 8.
Figure 16:
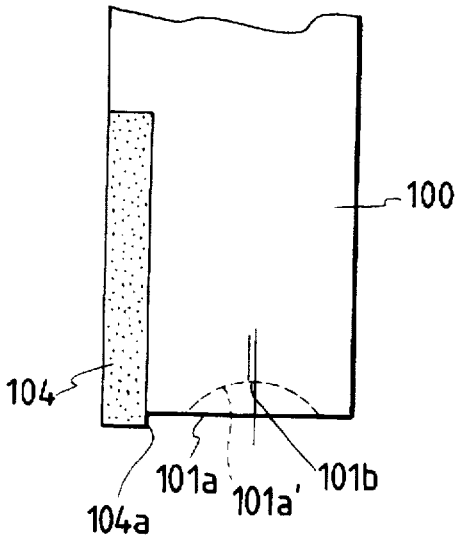
FIG. 16 is an explanation view showing the head unit in which an ink discharge port array face is concave as the variation of FIG. 9.

FIGS. 15 and 16 show still further two examples. They are head units of the almost same shape as shown in FIGS. 8 and 9, though the discharge port 101*b* is disposed in a recessed portion 101*a*' of the discharge face for protecting the discharge port 101*b*.

Figure 17:
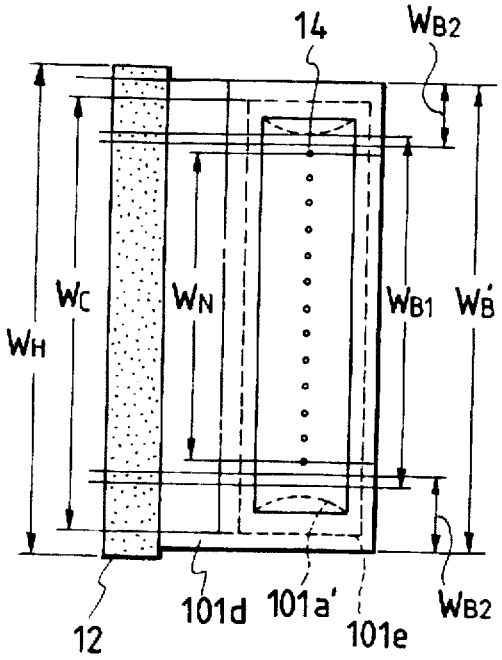
FIG. 17 is an explanation view for explaining the relation between the range of ink discharge port array, the cap width, and the first and second blade widths.

For such a head, the relation as shown in FIG. 17 can be adopted. That is, the discharge face is formed of a cap contact face 101*e* and a recessed face portion 101*a*' to be wiped, in which the wiping is performed with two blades of a first blade having the width WB1 for wiping the discharge port actually, and a second blade having the WB2 for wiping the cap contact face outward thereof. The width of cap is WC.

The following relation will stand between the blade width WB' (maximum blade width formed of WB1 and WB2) and the cap width WC.

WB1<WC, WN<WB1, but WB'>WC

That is, the blade width WB1 for wiping the periphery of discharge ports must be wider than the width of the array of discharge ports WN, but not necessarily wider than the cap width WC, in which it is indicated that the maximum width WB' of the first blade width WB1 plus the second blade width WB2 is sufficient to be wider than the cap width WC in order to wipe out the cap trace.

It will be appreciated that the above relation can equally apply to the head unit of the shape as shown in FIGS. 5 and 6 or FIGS. 11 and 12, with its discharge port disposed in the recessed portion.

Moreover, the above example describes a constitution where the wiping is made in the main scan direction (print direction), but the same effects can be obtained even if the wiping is made in an orthogonal direction e to the scan direction c. This is the same even if the carriage 2 is provided with the absorbing member 73.

(3.4) Shape of discharge port and wiping direction

The relation between the shape of discharge port and the wiping direction in this example will be described, which is defined to prevent disadvantages such as a trouble of dusts returned inward into discharge ports with the wiping, a trouble of the ink pulled out from discharge ports, and the color mixture. The wiping conditions in this example have a rubber hardness of 65° (JIS A), a free length L=9 mm, a penetrating amount into the discharge port d=1.5 mm, a thickness t=0.7 mm, and a wiping speed v=180 mm/sec, as the contact conditions, and urethane rubber as the material of the blade 401.

Figure 19:
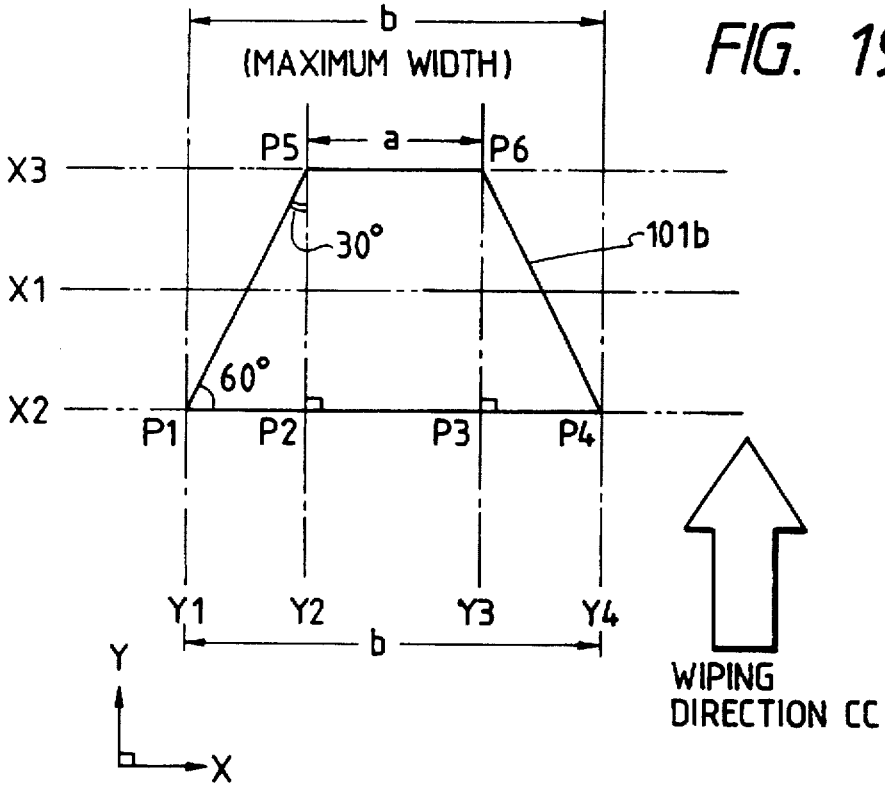
FIG. 19 is an explanation view for explaining the wiping direction for the discharge port of a trapezoidal shape.
Figure 20:
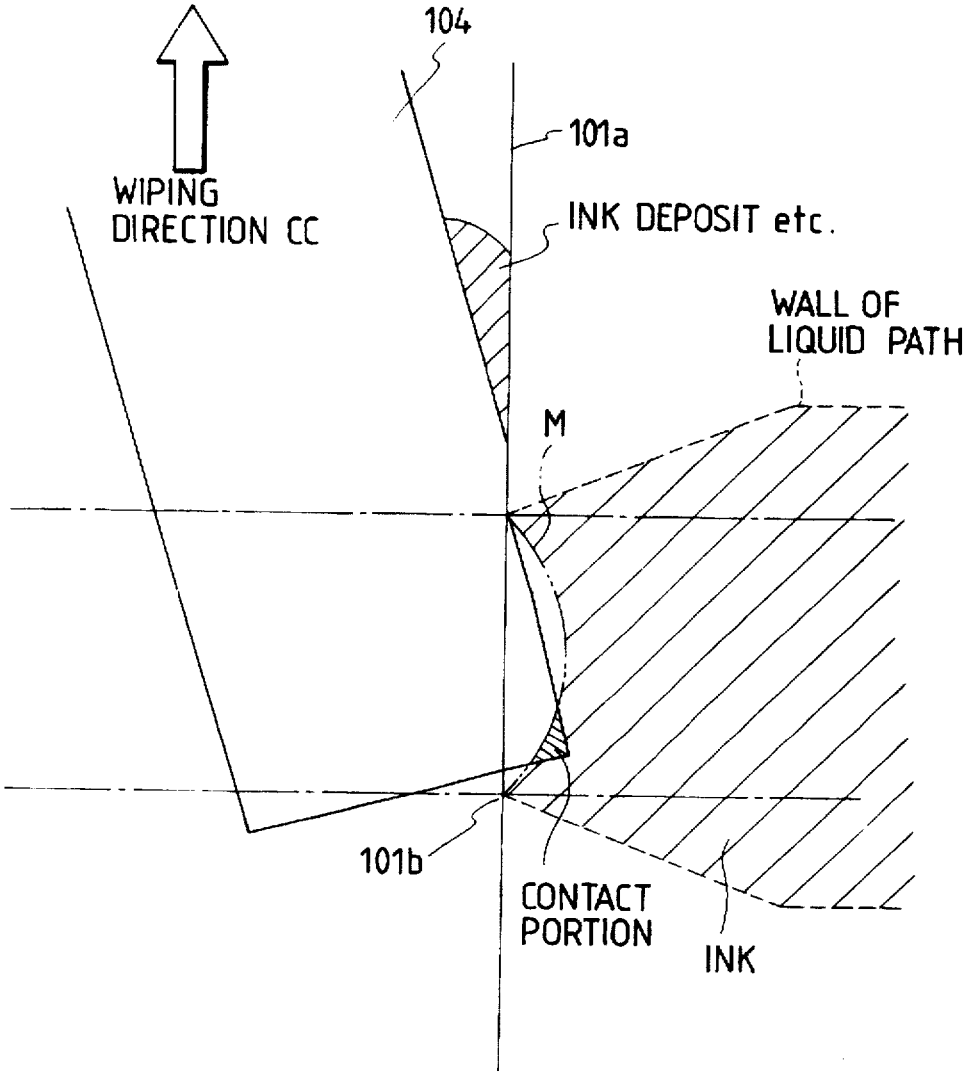
FIG. 20 is an explanation view for explaining the wiping as well.

In FIG. 19, the shape of the discharge port for the head is trapezoidal (isosceles trapezoid in this example) with a plurality of discharge ports formed in the X direction in the figure.

For the trapezoid, with the axes X2, X3, Y1, Y2, Y3, Y4 passing through the vertices P1, P4, P5, P6, the trapezoid has the upper base a, the lower base b and the height (b-a) (where b>a). Note that the angle made by (P5) (P1) (P2) is 60°, and the angle made by (P1) (P5) (P2) is 30°.

Next, considering X1 as the axis in the direction perpendicular to the wiping direction CC (opposite direction to the carriage moving direction C in FIGS. 5 and 11 in the apparatus of this example), it can be found that the trapezoidal shape of the discharge port is in line symmetry with respect to this axis. The X1 axis is equal to the X2 axis (referred to as a separation axis) at the maximum of X1 intercepted by the periphery of the discharge port (maximum width b), resulting in two line segments being intercepted at the intersections P1 and P4 between the X2 axis and the periphery of the discharge port (a line segment forming the contour). One of them is a line segment passing from P1 through P2, P3 to P4 (referred to as a peripheral length component 1, the length L1=b), and the other is a line segment passing from P1 through P5, P6 to P4 (referred to as a peripheral length component 2, the length $L2=a+\sqrt{3}(b-a)$). The relation between the peripheral length components 1, 2 is L1<L2.

In this example, the wiping is made in the CC direction for the discharge port as shown in FIG. 19, whereby it is possible to reduce the contamination of dust, the amount of ink pulled out from the discharge port, and the color mixture.

The relation between the wiping direction and the shape of the discharge port for producing such effects will be described in detail.

(i) The expected amount of contamination into the discharge port, when dusts (dust or paper powder) or thickened or fixed ink adhering to the periphery of discharge port are wiped with the blade, depends on the wiping direction. That is, the amount of dusts or thickened or fixed ink adhering to the periphery of discharge port is proportional to the peripheral length of discharge port, and the contamination of foreign matters into the discharge port is greatest when the blade passes through the maximum width of discharge port in the moving direction of the blade. It tends to increase with a larger peripheral length of discharge port up to making contact with the inside of discharge port, in the process that the blade makes contact with the inside of discharge port after coming into contact with the peripheral length of discharge port.

In FIG. 19, the contamination of dusts or thickened or fixed ink (hereinafter referred to as impurities) into the discharge port corresponds to the amount of L1 (=b) when cleaning in the wiping direction CC, while the contamination of impurities occurs by the amount of L2 ($=a+\sqrt{3}(b-a)$) when cleaning in the opposite direction, in which more impurities are entered by a differential amount of impurities ($L2-L1=a-b+\sqrt{3}(b-a)$).

(b) A phenomenon in which the blade 104 penetrates into the discharge port 101*b*, making contact with the meniscus M of the ink formed within the discharge port when the blade is moved, and pulling the ink adhered to the blade out of the discharge port (the amount of pulling out the ink may vary with the surface tension of the ink itself and the water repellent property of the blade) depends on the wiping direction. That is, the length of the blade in contact with the discharge port when the blade 104 passes through the discharge port is related to the amount of pulling out the ink, which tends to increase with a greater peripheral length of the discharge port in parallel to the blade. Also, the amount of pulling out ink is related to the wiping speed and the penetrating amount of the blade into the discharge port, in which the amount of pulling out the ink will decrease with a larger speed, but at the same time the wiping performance fundamental for the wiping tends to decrease. And the amount of pulling out the ink will decrease with a larger penetrating amount, while the wiping performance tends to decrease. That is, the amount of pulling out the ink is greatly related to the contact condition with the blade, but it is desirable that the extension of the contact condition will be permitted if the wiping direction is defined as in this example.

Figure 21A:
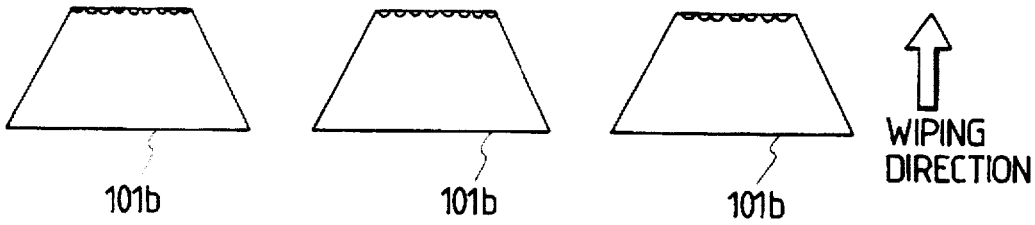
FIGS. 21A and 21B are explanation views for explaining the result of different wiping directions.
Figure 21B:
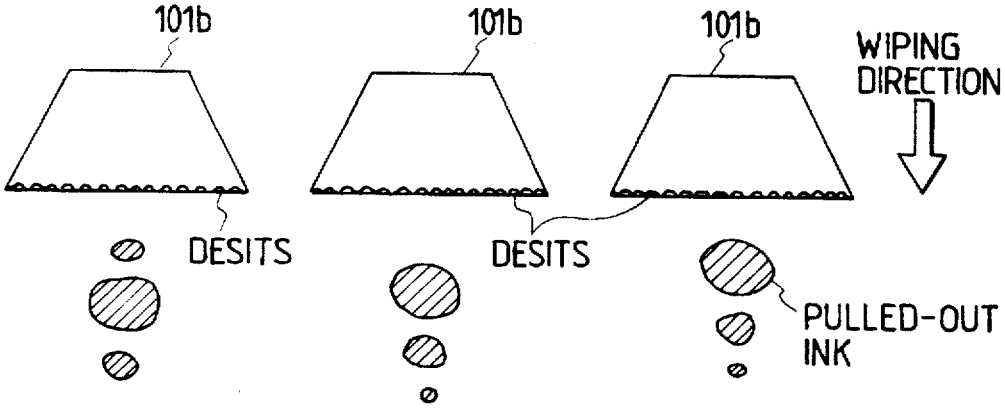

In FIG. 19, the blade into comes contact with the length a (in proportion to the amount of adhering ink) upon the separation from the discharge port, for the cleaning in the wiping direction CC, while it comes into contact with the length b for the cleaning in the reverse direction, with a greater amount of pulling out the ink, wherein more ink is pulled out by a difference amount of (b–a). In FIGS. 21A and 21B, the pulling out of the ink is shown in the same wiping direction as in this example, and its reverse direction.

(c) Due to the same phenomenon as described in (b), the amount of adhering ink to the blade will increase with a greater amount of pulling out the ink, in which the ink of different color is passed to the head downstream in the wiping direction, with the movement of the head, and the color mixture occurs in making contact with the inside of discharge port again. As this phenomenon is the same as in (b), the explanation is omitted.

FIG. 22 is a view for explaining another example. In this example, the constitution of a simple head and the wiping direction will be described.

Figure 22A:
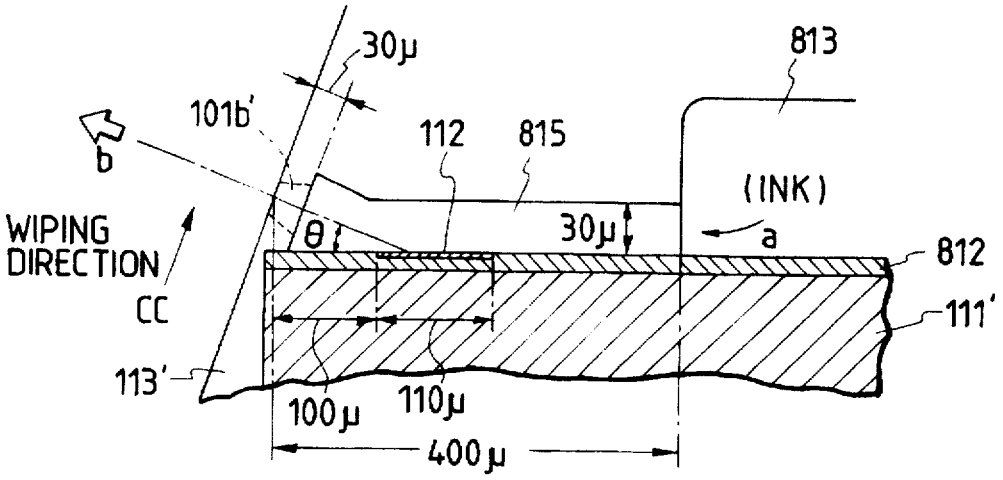
FIGS. 22A and 22B are a side cross-sectional view and an elevational view for explaining the wiping direction for the discharge port of another shape.
Figure 22B:
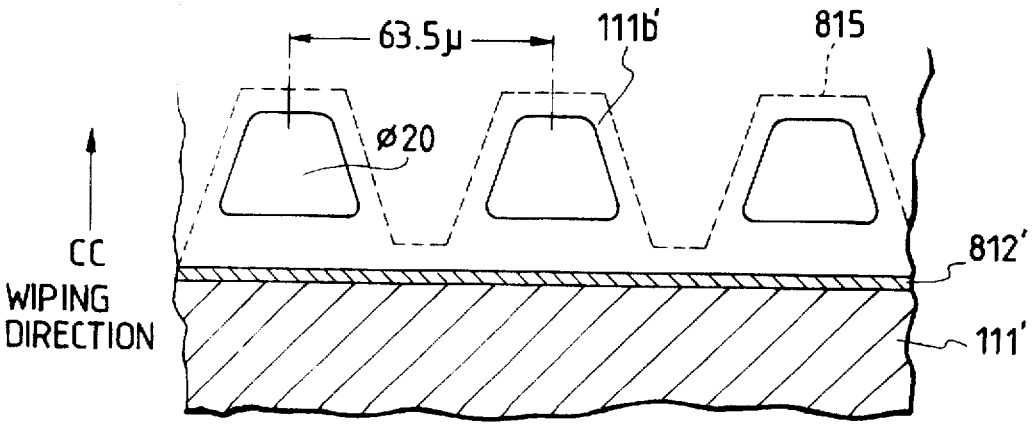

FIG. 22A is a cross-sectional constitutional view of the head, and FIG. 22B is an elevational view of the head, illustrating the shape of a discharge port 111*b*'. The head is constituted such that a base plate 111' of aluminum has a silicon chip laid thereon, on which a heater board 112' formed of heater or semiconductor is provided. A common liquid chamber 813 and a groove for forming a liquid channel 815 are provided thereon, with a grooved ceiling plate 113' of PSF (polysulfone) having integrally a discharge port formation plate being pressed against a silicone chip with the same spring 114 as previously described. Note that the base plate 111' and the ceiling plate 113' are joined inclinedly at an angle $\theta=15°$. The wiping direction of the blade is in the CC direction as shown. The shape of discharge port is fundamentally trapezoidal, with rounded corners. They serve to separate the ink from the discharge port 111*b*' as well as reducing the resistance of flow passage, thereby raising the characteristics of discharging. The reason why the shape of discharge port for the head is wider on the heater side is that the structure of flow passage inward of the discharge port may offer the bubbling stability owing to the trapezoidal shape and that the unsteadiness is prevented in boring the discharge port in the ceiling plate with the laser.

Figure 23:
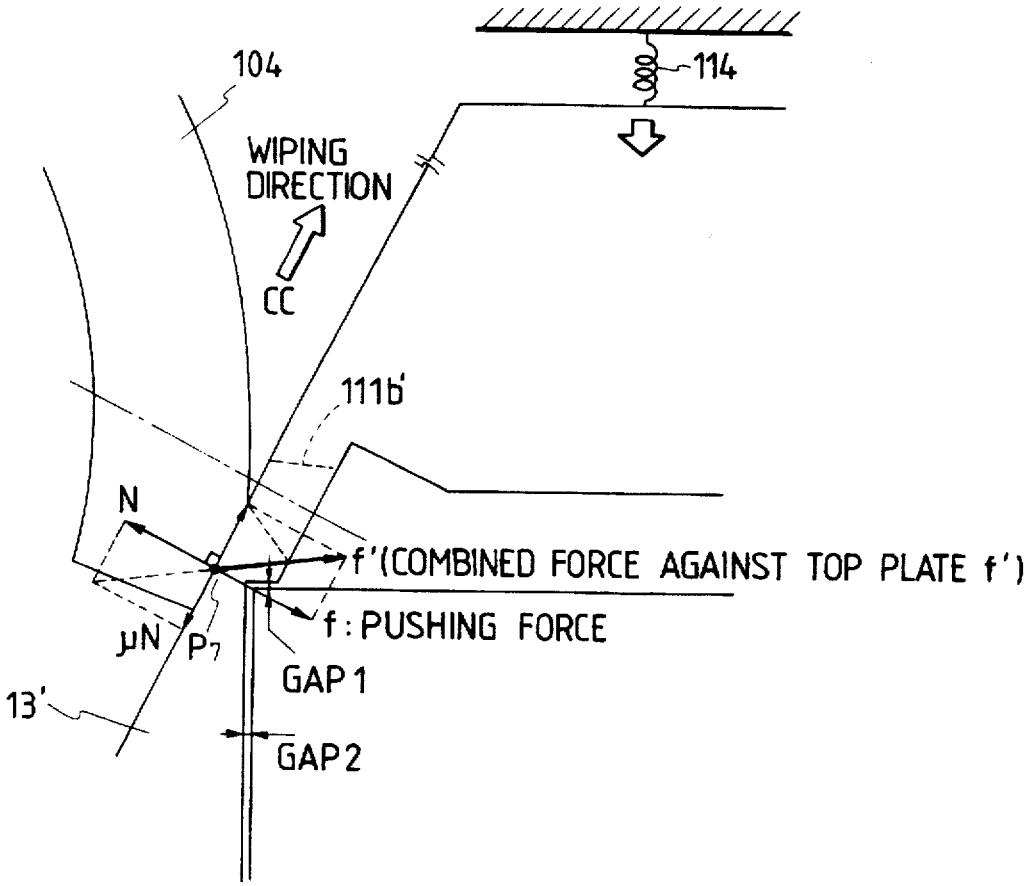
FIG. 23 is an explanation view for explaining the wiping as well.

Next, the relation between the head structure of this example and the wiping direction will be described in detail. FIG. 23 is an enlargement of FIG. 22, showing the relation of forces to be exerted by the blade in wiping. If the wiping is made in the direction as shown, the combined force f' of a blade pushing force f and a frictional force μN is applied to force the grooved ceiling plate to be moved in the direction of the combined force. In the wiping direction of this example, gap2 is forced to be narrower, while gap2 is forced to be wider in the opposite wiping direction. Here, the gap1 and gap2 will be described. The gap1 is involved in the crosstalk (escaping of bubbling power) in the array direction (between adjacent liquid channels), while the gap2 is involved in the crosstalk on the front side of one channel, in either of which the crosstalk is greater with a wider gap. The crosstalk causes some trouble such as irregular discharge speed, unsteady discharge amount, deflection or undischarge to occur. The gap1 is designed to be always constant with a spring load from the upper side, while the gap2 relies on a frictional force between the grooved ceiling plate and the silicone chip, and thus is likely to vary. Accordingly, it is desirable to make the wiping with the method of this example.

Figure 24A:
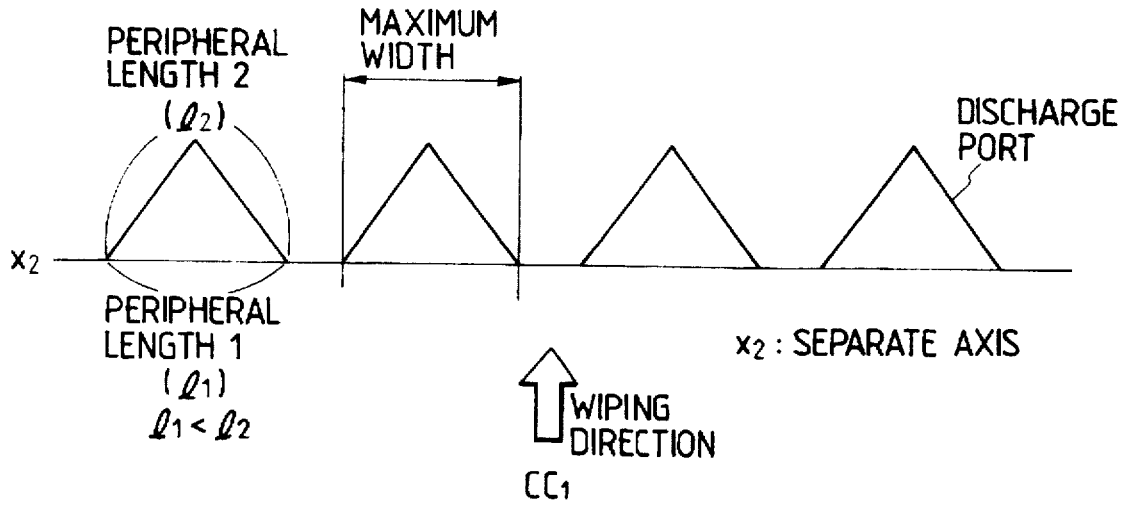
FIGS. 24A and 24B are explanation views for eexplaining the wiping direction for the discharge oprt of another shape.
Figure 24B:
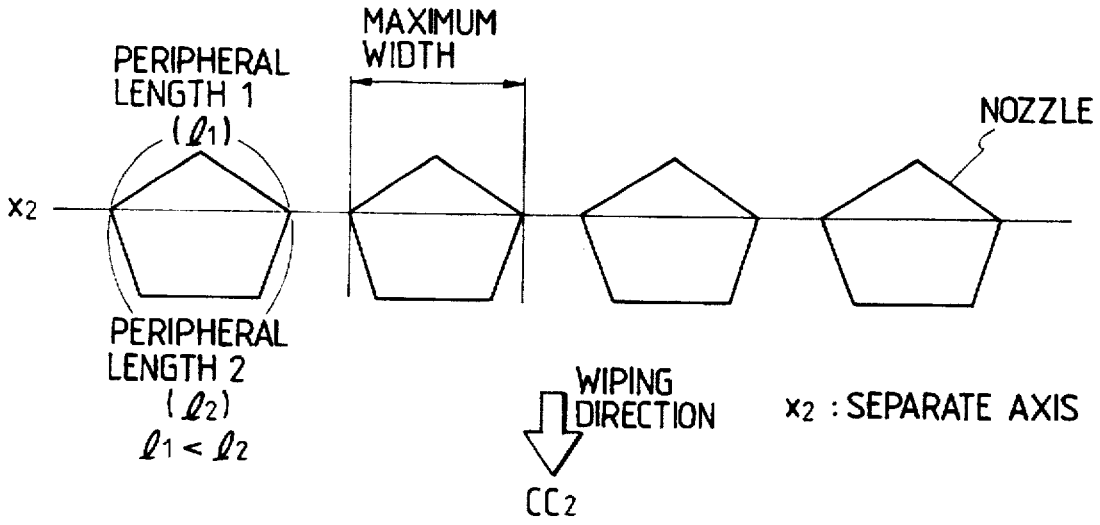

FIG. 24 is a view for explaining another example. FIG. 24A shows a discharge port of triangular shape, and FIG. 24B shows a discharge port of pentagonal shape. On the basis of the same concept of the above example, the wiping direction is CC1 in FIG. 24A and CC2 in FIG. 24B.

Note that the above example is described in connection with the polygon, but is also applicable to the curved configuration.

In this way, it is possible to maintain the function of the cleaning blade steady at all times by causing the blade to rub against the absorbing member disposed on the recording head or the carriage.

However, in an instance where the absorbing member is disposed in a recessed portion of the discharge port face of the recording head so as not to cause the absorbing member to swell with the absorption of the ink and make contact with the recording sheet, the adhering ink to the blade can not be completely absorbed.

Figure 25A:
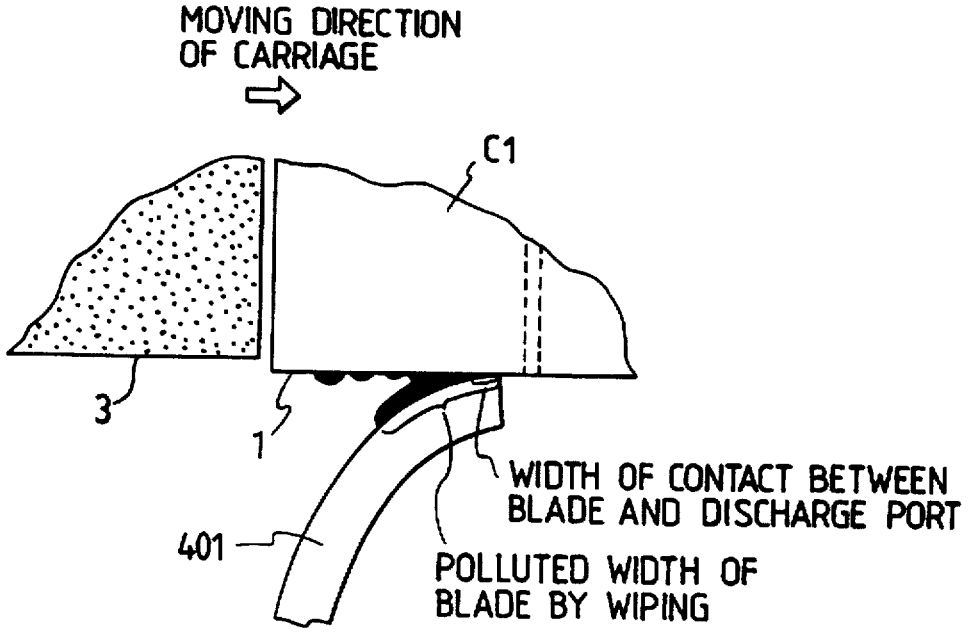
FIGS. 25A and 25B are enlarged explanation views for explaining the wiping operation.

This point will be described with reference to FIGS. 25A and 25B. FIG. 25A shows how to remove the ink on the discharge port face, with the blade 401 being moved relatively, in contact with the discharge port face 1 across a certain width, but in an apparatus of the type in which the ink is discharged downward in the gravitational direction, the wiped and gathered ink is likely to flow along the blade 401 downstream in the gravitational direction, so that the polluted width of the blade 401 due to the ink may extend over a wide area beyond the width in contact with the discharge port face 1.

Figure 25B:
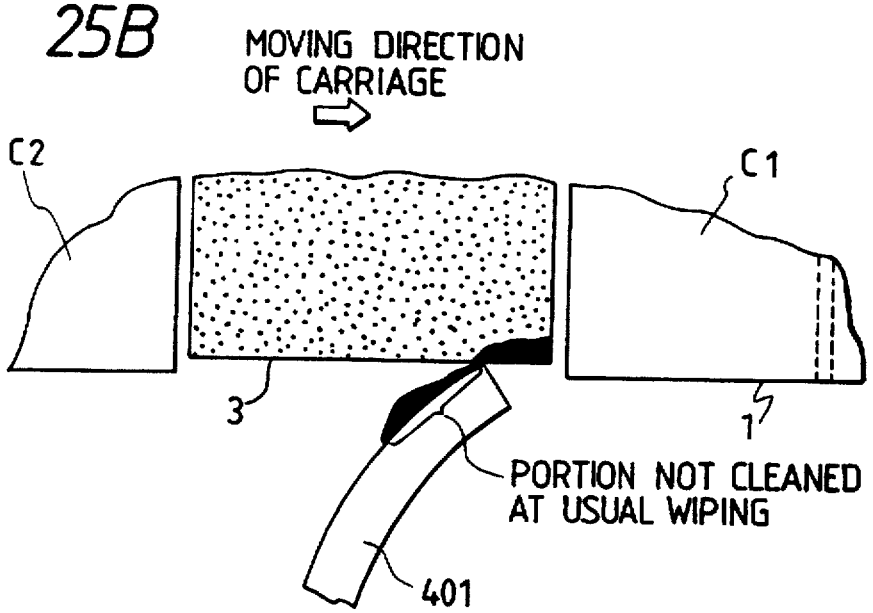

Then, the adhering ink to the blade 401 will be removed by making contact with the blade cleaning absorbing member 3, as shown in FIG. 25B, but the blade cleaning absorbing member 3 can not be placed at the position projected from the discharge port face 1, and is set to be recessed about 0.5 mm from the discharge port face for the safety, so that the penetrating amount of the blade 401 into the blade cleaning absorbing member is smaller than that into the discharge port face 1. As a result, the blade cleaning absorbing member 3 can absorb the ink at a top end of the blade 401, or in an area in contact with the absorbing member, but the ink remaining beyond that area is left in the blade 401. In the early times of use, it is permissible to ignore any disadvantages on the discharge characteristics affecting the image quality, such as deflection or undischarge and the color mixture, even if the wiping is made for the discharge port face 1 of the next recording head while a slight amount of ink may remain below the width in contact with the discharge port face, but in long term service, residual ink may evaporate to be thickened and fixed, and gradually deposited together with dusts such as paper powder, so that such deposits may reduce the wiping performance of the blade and affect the discharge characteristics or the image quality.

Thereby, there is provided a mode in which the cleaning is made over the entire area of adhering ink.

Figure 26:
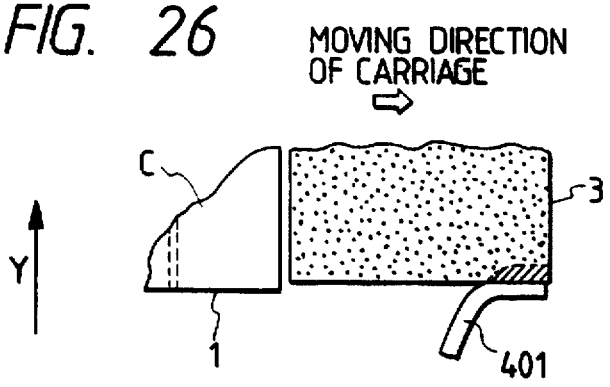
FIG. 26 is a schematic view for explaining the operation of cleaning mode.

The blade cleaning mode will be described with reference to FIG. 26. In the blade cleaning mode, the blade 401 is projected from a wiping position in the Y direction, and set at a position where the penetrating amount into the blade cleaning absorbing member 3 is deeper than that at the normal wiping, by twice or more in this example. And the carriage 2 is moved from left to right side, and the blade is lowered to a waiting position when the carriage has passed therethrough, and then the carriage is returned to a home position. By doing so, the contact area between the blade 401 and the blade cleaning absorbing member 3 can be extended, so that it is possible to clean the portion which can not be wiped at the normal wiping. This operation is performed once, but preferably twice or more in succession for further effects.

Note that the penetrating amount of the blade is not limited to twice, but may be about 1.5 to 4 times as the practical range as it is only necessary to wipe the adhering ink to the blade excellently.

Figure 27:
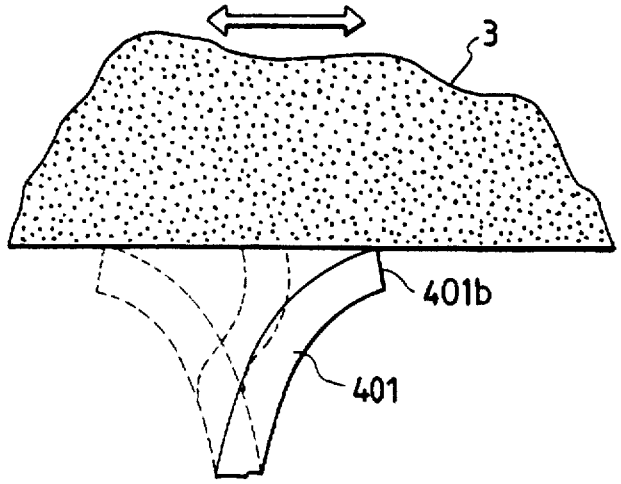
FIG. 27 is a schematic view for explaining another cleaning operation.

If the absorbing member is disposed on a side face of the discharge port formation face of the recording head, particularly, on the upstream side in the wiping direction, as shown in FIG. 27, the adhering ink to the blade can be scraped off with its edge portion more completely, so that a more reliable wiping can be accomplished.

If the normal wiping operation or predischarge is performed after the blade cleaning operation in order to improve the reliability, the influence of the ink on the head which has been wiped before can be almost eliminated, and an excellent recording can be made.

Various conditions in this example are shown below.

Blade:

thickness 0.7 mm±0.1 width 12.0 mm±0.1 free length 8.0 mm±0.1 penetrating amount at wiping (into discharge port face) 1.5 mm±0.5 penetrating amount at blade cleaning (into discharge port face) 4.0 mm±0.5

Carriage moving speed:

at wiping 200 mm/sec±30 at cleaning 100 mm/sec±30

Used recording head:

400 dpi 128 nozzles

Sequence in wiping operation: for every recording for one sheet of A4

Sequence in blade cleaning mode: for every recording for 100 sheets of A4

Test environment: high temperature/low humidity (35° C./10%)

In connection with the wiping speed, the wiping effect or the ink absorbing effect may decrease with a faster speed, particularly due to slippage, but it is confirmed that there is no problem below 300 mm/sec. It is preferable that the cleaning speed is slower than at the normal wiping. This is because the adhering ink to the blade is absorbed into the absorbing member more slowly as it is thickened due to the evaporation. The test environment was in a severe condition having a quantity of discharging the ink with the wet ink in a low humidity environment at high temperature, in dryness, and easy to evaporate.

In the above conditions, an endurance test for 5000 sheets of A4 size was performed, with the amount of wet ink on the discharge port face of the head being set at maximum with the all black recording at a recording ratio of 100%, so that there occurred no discharge failure such as deflection or undischarge.

In contrast, an endurance test, excluding the sequence of blade cleaning mode, among the above-mentioned conditions, was performed, so that a discharge failure appeared after several hundreds of sheets.

In this way, by providing the blade cleaning mode, a great improvement in the endurable number of sheets can be achieved.

While the color recording using four ink jet cartridges for the carriage 2 was described in this example, this number is not limited in particular, but a single or any other number of recording heads can be mounted. In the color image recording, there is a specific problem of the color mixture, but the present invention can also resolve that problem, and exhibit a great effect in the color recording.

If the wiping is made for the discharge port face 1, a top face **401*b* of the blade 401** is also polluted, which causes a trouble of degrading the wiping performance called as the unwiping. This tendency will appear significantly with the wiping of the type of making the cleaning in contact with the discharge port face, particularly in both directions.

Accordingly, it is also necessary to clean the top end face **401*b* of the blade. This example offers a blade cleaning method effective in this case. In the blade cleaning mode, the blade cleaning absorbing member 3 is reciprocated in the forward and backward directions, with the blade 401 being in contact with the blade cleaning absorbing member 3, as shown in FIG. 27. Then the blade works in the reversal behavior as shown in solid and broken lines, in which the top end face 401*b* is placed into contact with the blade cleaning absorbing member 3** temporarily, and thereby cleaned. With this cleaning operation, it is preferable that the penetrating amount of the blade is shallower than at during the normal wiping operation, because the reversal behavior is less likely to occur with larger penetrating amount. This third example can exhibit a greater effect in combination with the first or second example.

In the described examples, the penetrating amount can be changed by lifting the blade, but if there is a sufficient space, the same action and effect can be obtained by lifting the carriage, or lifting both, as long as the positional relations between the blade, the blade cleaning absorbing member and the discharge port face are the same.

The absorbing member for absorbing the adhering ink to the cleaning blade, excellent in the cleaning characteristics, may degrade in the ink absorbing characteristic with a greater absorption of the ink, and lack in the reliability in a long term. In long term service, there occur several disadvantages foreign matters such as paper powder or dusts and the thickened ink are deposited on a surface of the absorbing member to decrease the cleaning performance significantly. Moreover, such foreign matters on the absorbing member may be retransferred to the blade.

Additionally the ink may adhere to a cap for use in the discharge recovery process and be retransferred to the head face every time the wiping is made for the head using the blade, causing the head face to become dirty, and the ink, if thickened, is not only difficult to remove with the wiping, but may also be forced into the nozzle, causing a discharge failure.

Thus, this example has proposed that the blade and the cap member are cleaned by the use of a cleaning dedicated head mountable on the carriage of a similar shape to the recording head and having the cleaning function.

This cleaning dedicated head has preferably a porous absorbing member, which absorbs unnecessary ink with the blade and the cap rubbing and pressing against the absorbing member for the cleaning, thereby preventing the degradation in the performance of recovery means.

More preferably, the washing is impregnated into the absorbing member of the cleaning dedicated head, to thereby remove persistent dirts adhering to the blade and the cap, and further improve the cleaning effect, so that the good performance of recovery means can be maintained for a long term.

Figure 28:
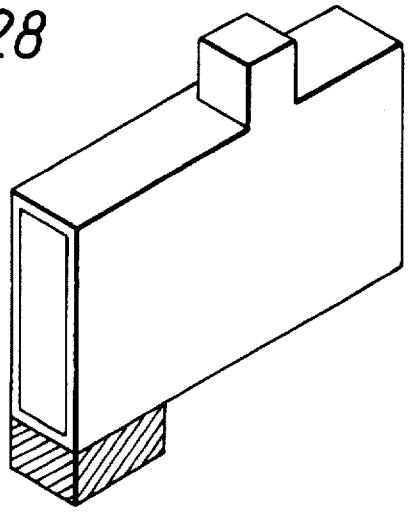
FIG. 28 is a schematic perspective view of a cleaning dedicated cartridge.
Figure 29B:
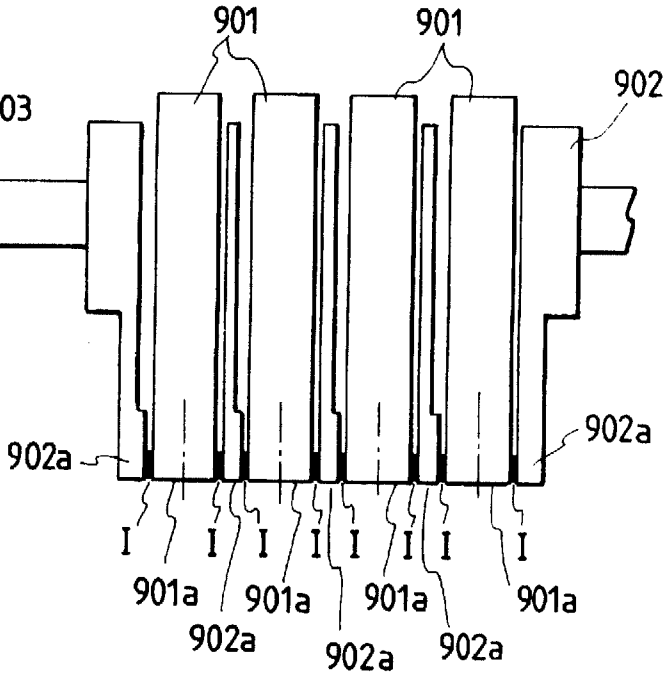
FIGS. 29A and 29B are views for explaining the behavior in the conventional cleaning.
Figure 29A:
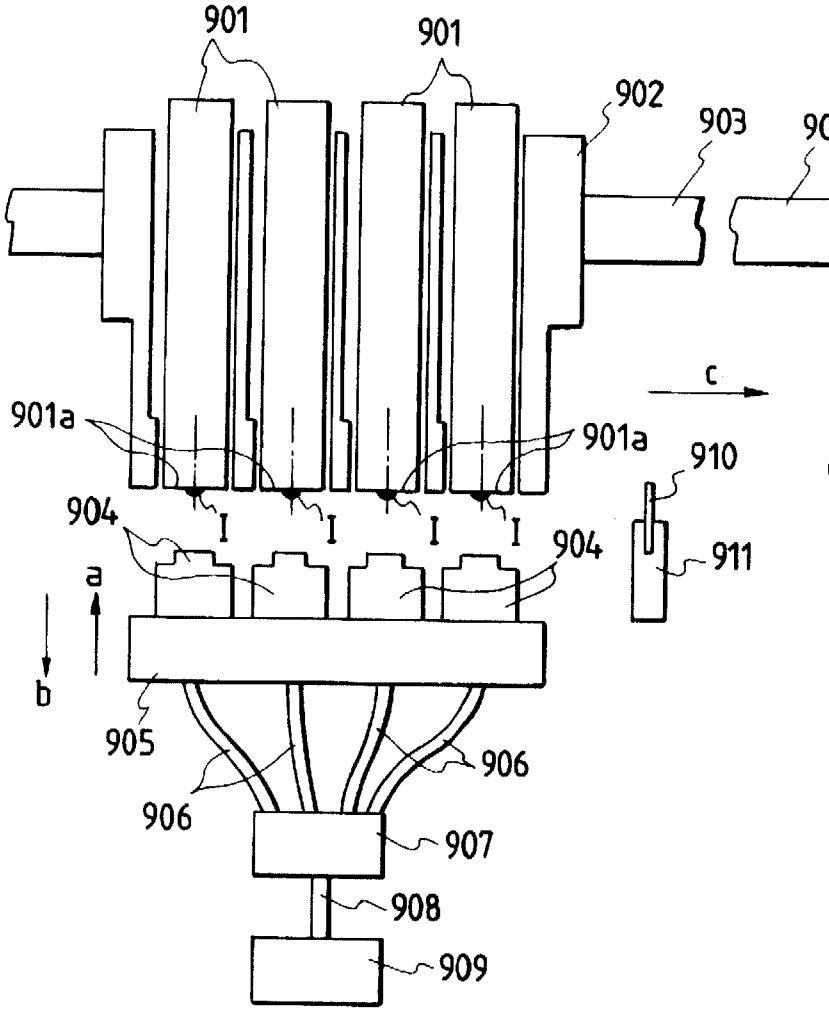

FIG. 28 shows a cleaning dedicated cartridge of recovery unit in the present invention. This is one in which a recording head portion of ink jet cartridge C is replaced with an absorbing member. This is of the shape similar to the ink jet cartridge, and mountable on the carriage. This absorbing member portion is used to clean the recovery unit, particularly, the cap portion and the blade portion. The absorbing member portion slightly projects toward the recovery unit side to facilitate the cleaning for the recovery unit.

Using this cleaning dedicated cartridge, a recovery unit cleaning mode is provided to periodically clean the blade 401 and the cap.

The recovery unit cleaning mode will be described below. In the recovery unit cleaning mode, the recording head cartridge is first demounted from the carriage, and the cleaning dedicated cartridge is mounted instead.

The blade 401 is further projected from a wiping position in the Y direction, and set at a position where the penetrating amount into the blade cleaning absorbing member 3 is deeper than that during normal wiping. And the carriage 2 is moved from left to right side, and the blade 401 is lowered to a waiting position when the carriage has passed therethrough, and the carriage 2 is returned to a home position and capped. By doing so, the contact area between the blade 401, the blade cleaning absorbing member 3 and the absorbing member portion of the cleaning dedicated cartridge can be extended, so that it is possible to clean the portion unwiped during normal wiping. This operation is performed once, but may be preferably performed twice or more in succession for further effects.

Note that if the capping is made with the cleaning dedicated cartridge mounted, unnecessary ink adhering to the cap can be absorbed into the absorbing member of the cleaning dedicated cartridge to thereby realize a cleaner state.

Various conditions in this example are shown below.

Blade:

thickness 0.7 mm±0.1 width 12.0 mm±0.1 free length 8.0 mm±0.1 penetrating amount at wiping (into discharge port face) 1.5 mm±0.5 penetrating amount at blade cleaning (into discharge port face) 4.0 mm±0.5

Carriage moving speed:

200 mm/sec±30

Used recording head:

400 dpi 128 nozzles

Sequence in wiping operation:

for every recording for one sheet of A4

Cleaning for recovery unit:

for every recording for 100 sheets of A4

Test environment:

high temperature/low humidity (35° C./10%)

In connection with the wiping speed, the wiping effect or the ink absorbing effect may decrease with a faster speed, particularly due to slippage, but it is confirmed that there is no problem below 300 mm/sec. The test environment was in a severe condition with a quantity of discharging the ink and a quantity of wet ink, that is, in a low humidity environment at high temperature, in dryness and easy to evaporate.

In the above conditions, an endurance test for 30000 sheets of A4 size was performed, with the amount of wet ink being set at maximum with the all black recording at a recording ratio of 100%, so that there occurred no discharge failure such as deflection or undischarge. Also, the suction performance after the endurance test showed that it was hardly changed from the performance before the endurance test.

The use of the recovery unit cleaning dedicated cartridge allows a great improvement in the endurable number of sheets and the preservation of the performance in the recovery unit over a long term service.

While this example was described using four ink jet cartridges for the carriage 2, this number is not particularly limited, a single or any other number of recording heads can be mounted.

The shape of the absorbing member for the cleaning dedicated head is likewise not particularly limited. Any shape with improved cleaning capability such as the shape having irregular surface, the shape to be easily scraped, or the shape enclosing an abutting portion of the cap which is easily polluted, may be used.

The recovery unit cleaning dedicated cartridge of another form will be described below. This is one in which the recovery liquid for dissolving the thickened or fixed ink is contained in a tank portion of the cleaning dedicated cartridge, communicating to the absorbing member, which is also impregnated with the recovery liquid. The recovery liquid is not particularly limited as long as nonvolatile matters contained in the ink are easy to dissolve. The thickened ink has a high viscosity and is absorbed relatively slowly into the absorbing member. Further, if it is solidified, it is hardly absorbed into the absorbing member. Thus, by soaking a solution for dissolving the thickened or solid ink into the absorbing member, the thickened ink adhering to the blade and the cap is made to be easily dissolved and absorbed.

If the thickened ink on the cap and the blade is placed into contact with the dissolving liquid within the absorbing member, the density difference of the ink may occur, the thickened ink tending to spread into the inside of the absorbing member having less density, so that the ink on the cap and the blade can be removed.

The present invention brings about excellent effects particularly in a recording head or a recording device comprising means (e.g., electricity-heat converter or laser beam) for generating a heat energy as the energy for use in discharging the ink, and causing the state of ink to be changed with the heat energy, among the various ink jet recording systems. With such a method, the higher density and higher resolution of recording can be obtained.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. Nos. 4,558,333 or 4,459,600 disclosing the constitution having the heat acting portion arranged in the flexed region is also included in the present invention. In addition, the present invention can be also effectively made the constitution as disclosed in Japanese Patent Application Laid-Open No. 59-123670 which discloses the constitution using a slit common to a plurality of electricity-heat converters as the discharging portion of the electricity-heat converter or Japanese Patent Application Laid-Open No. 59-138461 which discloses the constitution having the opening for absorbing pressure wave of heat energy corresponding to the discharging portion. With the present invention, the recording can be made assuredly and efficiently whatever form the recording head may take.

Further, the present invention is also effectively applicable to the recording head of the full line type having a length corresponding to the maximum width of a recording medium which can be recorded by the recording device. As such a recording head, either the constitution which satisfies its length by a combination of a plurality of recording heads or the constitution as one recording head integrally formed may be used.

In addition, among the several types in the above example, the present invention is also effective for a recording head secured to the main device, a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

Further, as the type of the recording head to be mounted and the number of heads, the present invention is effective to a single recording head provided corresponding to the monocolor ink or a plurality of recording heads provided corresponding to a plurality of inks having different recording colors or densities, for example. That is, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural number.

Though the ink is considered as the liquid in the examples of the present invention as described above, the present invention is applicable to either of the solid or soft ink at room temperature. With the above ink jet device, as it is common to control the viscosity of ink to be maintained within a certain range for stable discharge by adjusting the temperature of ink in a range from 30° C. to 70° C., it is necessary that the ink is in a liquid state when a recording enable signal is issued. In addition, in order to avoid the temperature elevation due to the heat energy by positively utilizing it as the energy for the change of state from solid to liquid, or to prevent the evaporation of ink by using the solid ink in the shelf state, the present invention is also effectively applicable to the ink having a property of liquefying only with the application of heat energy so that the ink liquefies with the application of heat energy in accordance with a recording signal and is discharged as the liquid ink, or the ink already solidifies when reaching a recording medium. In this case, the ink may be in the form of being held in recesses or through holes of porous sheet as liquid or solid matter, and opposed to electricity-heat converters, as described in Japanese Patent Application Laid-Open No. 54-56847 or Japanese Patent Application Laid-Open No. 60-71260. The most effective method for inks as above described in the present invention is one based on the film boiling as above indicated.

As above described, it is possible to prevent adverse effects on the semiconductor device or electrical connections due to the scattering of the ink, and fabricate a reliable recording apparatus in such a manner as to 1) provide an ink absorbing member in the vicinity of the ink discharge port on the mounting side of the semiconductor device within the head.

2) provide a semiconductor storage device and electrical connections to the external of the head at a position 30 mm away from the ink discharge portion as the structure of recording head.

With the present invention, it is possible to maintain the stable wiping characteristic at all times because there is no deposition of thickened or fixed ink on the blade by providing the blade cleaning mode in which the penetrating amount of the blade into the blade cleaning absorbing member is deeper than at the normal wiping.

Further, according to the present invention, by determining the wiping direction suitable for the shape of discharge port, an ink jet recording head having the discharge ports of complex or special shape in consideration of the stabilization of discharge characteristics, and the liquid channels, makes it possible to reduce dust or thickened ink returning inward to the discharge port with the wiping, as well as the amount of pulling out the ink from the discharge port in wiping, and prevent the color mixture in wiping a plurality of heads, so that the image quality can be stabilized with stabler discharge characteristics of the head and an improved reliability, almost without recording deflection or undischarge. In particular, when the discharge port is formed as a polygon (or a polygon having rounded corners), there is a great effect in wiping the ink jet recording head.

Further, according to the present invention, it is possible to clean the wiping member in such a manner as to cause the wiping member to engage an absorbing member disposed in the vicinity of the discharge portion of recording head, after wiping the discharge portion, or an absorbing member provided on a head mount such as carriage. Also, it is possible to perform the absorbing operation of the ink more securely if the absorbing member on the head side is made convex, and/or an end face portion on the discharge portion is made concave.

Accordingly, as impurities having the adverse effect on the head such as dust or thickened or fixed ink adhering to the wiping member or cap can be removed beforehand, and efficiently, an excellent effect can be exhibited against conventional troubles such as a trouble of the ink accumulating in the gap between head and carriage, a trouble of the ink swept in wiping, the color mixture in wiping a plurality of heads, the pollution of the operator in exchanging the cartridge head, with an improved durability and print characteristic.

Also, according to the present invention, it is possible to clean the wiping member in such a manner as to cause the wiping member to engage the absorbing member, after wiping the discharge portion, with the absorbing member disposed adjacent to the discharge portion of recording head.

Accordingly, as impurities having the adverse effect on the head such as dust or thickened or fixed ink adhering to the wiping member or cap can be removed beforehand, and efficiently, an excellent effect can be exhibited against conventional troubles such as a trouble of the ink accumulating in the gap between head and carriage, a trouble of the ink swept in wiping, the color mixture in wiping a plurality of heads, the pollution of the operator in exchanging the cartridge head, with an improved durability and print characteristic.

Further, in the present invention, by making clear the swelling rate and the liquid absorbing rate of absorbing member provided on the head, as well as the relation between the ink weight within the ink tank, the recordable ink weight, and the dimensions of absorbing member, it is possible to derive the optimum condition for the size, function, and cost on the constitution for the absorbing member.

Further, according to the present invention, it is possible to clean the wiping member in such a manner as to determine the dimensions of each portion appropriately, and cause the wiping member to engage an absorbing member disposed in the vicinity of the discharge portion of recording head, after wiping the discharge portion, or an absorbing member provided on a head mount such as carriage.

Accordingly, as impurities having the adverse effect on the head such as dust or thickened or fixed ink adhering to the wiping member or cap can be removed beforehand, and efficiently, an excellent effect can be exhibited against conventional troubles such as a trouble of the ink accumulating in the gap between head and carriage, a trouble of the ink swept in wiping, the color mixture in wiping a plurality of heads, the pollution of the operator in exchanging the cartridge head, with an improved durability and print characteristic.

Further, according to the present invention, by cleaning the recovery unit periodically using the cleaning dedicated head for the recovery unit, an ink jet recording apparatus can be realized in which the recording unit can be cleaned and recovered properly and stably even if the recovery unit becomes dirty in the unrecoverable state, while preventing the performance of the recovery unit from degrading, and maintaining the performance over a long term.

What is claimed is:

1. An ink jet recording apparatus for use with a recording head unit having a discharge port face having a discharge port for discharging ink, said apparatus comprising:

a cleaning member for cleaning said ink discharge port face;

an absorbing member for cleaning said cleaning member while being in contact therewith, said absorbing member being integral with said recording head unit; and means for setting a first cleaning mode of cleaning said discharge port face with said cleaning member and a second cleaning mode of cleaning said cleaning member with said absorbing member, wherein in the second cleaning mode said cleaning member is at a position so that a contact area between said cleaning member and said absorbing member is larger than a contact area between said cleaning member and said discharge port face in the first cleaning mode.

2. An ink jet recording apparatus according to claim 1, wherein said absorbing member is an ink absorbing member.

3. An ink jet recording apparatus according to claim 1, wherein said absorbing member is located upstream of the discharge port face with respect to a scanning direction of the recording head unit when said cleaning member cleans.

4. An ink jet recording apparatus according to claim 1, wherein said absorbing member is located downstream of the discharge port face with respect to a scanning direction of the recording head unit when said cleaning member cleans.

5. An ink jet recording apparatus according to claim 1, further comprising an ink tank.

6. An ink jet recording apparatus according to claim 1, wherein the recording head unit includes heat generating means for generating heat energy used to discharge the ink.

7. An ink jet recording apparatus according to claim 6, wherein said heat generating means causes rapid temperature elevation exceeding nucleate boiling in the ink in accordance with a driving signal, thereby causing formation of a bubble in the ink.

8. An ink jet recording apparatus according to claim 7, wherein the ink is discharged through the discharge port in accordance with growth and shrinkage of the bubble.

9. An ink jet recording apparatus for use with a recording head unit having a discharge port face having a discharge port for discharging ink, the recording head unit being scanned in a main scan direction across a conveyance direction of a recording medium, and a cleaning member for cleaning said ink discharge port face, said apparatus comprising:

an absorbing member for cleaning the cleaning member while being in contact therewith; and means for setting a first cleaning mode of cleaning said discharge port face with the cleaning member and a second cleaning mode of cleaning the cleaning member with said absorbing member, wherein said absorbing member is scanned in the main scan direction together with the recording head unit, and in the second cleaning mode the cleaning member is at a position so that a contact area between the cleaning member and said absorbing member is larger than a contact area between the cleaning member and the discharge port face in the first cleaning mode.

10. An ink jet recording apparatus according to claim 9, wherein the recording head unit includes heat generating means for generating heat energy used to discharge the ink.

11. An ink jet recording apparatus according to claim 10, wherein said heat generating means causes rapid temperature elevation exceeding nucleate boiling in the ink in accordance with a driving signal, thereby causing formation of a bubble in the ink.

12. An ink jet recording apparatus according to claim 11, wherein the ink is discharged through the discharge port in accordance with growth and shrinkage of the bubble.

13. An ink jet recording apparatus for use with a recording head unit having a discharge port face having a discharge port for discharging ink, said apparatus comprising:

a cleaning member for cleaning said ink discharge port face;

an absorbing member for cleaning said cleaning member while being in contact therewith, said absorbing member being integral with said recording head unit; and means for setting a first cleaning mode of cleaning said discharge port face with said cleaning member and a second cleaning mode of cleaning said cleaning member with said absorbing member, wherein a relative moving speed of the cleaning member and said absorbing member in the second cleaning mode is set to be slower than a relative moving speed of the cleaning member and said discharge port face in the first cleaning mode.

14. An ink jet recording apparatus according to claim 13, wherein the recording head unit includes heat generating means for generating heat energy used to discharge the ink.

15. An ink jet recording apparatus according to claim 14, wherein said heat generating means causes rapid temperature elevation exceeding nucleate boiling in the ink in accordance with a driving signal, thereby causing formation of a bubble in the ink.

16. An ink jet recording apparatus according to claim 15, wherein the ink is discharged through the discharge port in accordance with growth and shrinkage of the bubble.

17. An ink jet recording apparatus for use with a recording head unit having a discharge port face having a discharge port for discharging ink, the recording head unit being scanned in a main scan direction across a conveyance direction of a recording medium, and a cleaning member for cleaning said ink discharge port face, said apparatus comprising:

an absorbing member for cleaning the cleaning member while being in contact therewith; and means for setting a first cleaning mode of cleaning said discharge port face with the cleaning member and a second cleaning mode of cleaning the cleaning member with said absorbing member, wherein said absorbing member is scanned in the main scan direction together with the recording head unit, and a relative moving speed of the cleaning member and said absorbing member in the second cleaning mode is set to be slower than a relative moving speed of the cleaning member and said discharge port face in the first cleaning mode.

18. An ink jet recording apparatus according to claim 17, wherein the recording head unit includes heat generating means for generating heat energy used to discharge the ink.

19. An ink jet recording apparatus according to claim 18, wherein said heat generating means causes rapid temperature elevation exceeding nucleate boiling in the ink in accordance with a driving signal, thereby causing formation of a bubble in the ink.

20. An ink jet recording apparatus according to claim 19, wherein the ink is discharged through the discharge port in accordance with growth and shrinkage of the bubble.

21. An ink jet recording apparatus for use with a recording head unit having a discharge port face having a discharge port for discharging ink, said apparatus comprising:

a first cleaning member for cleaning said ink discharge port face;

a second cleaning member for cleaning said first cleaning member while being in contact therewith, said second cleaning member being integral with said recording head unit; and means for setting a first cleaning mode of cleaning said discharge port face with said first cleaning member and a second cleaning mode of cleaning said first cleaning member with said second cleaning member, wherein in the second cleaning mode said first cleaning member is at a position so that a contact area between said first cleaning member and said second cleaning member is larger than a contact area between said first cleaning member and said discharge port face in the first cleaning mode.

22. An ink jet recording apparatus according to claim 21, wherein the recording head unit includes heat generating means for generating heat energy used to discharge the ink.

23. An ink jet recording apparatus according to claim 22, wherein said heat generating means causes rapid temperature elevation exceeding nucleate boiling in the ink in accordance with a driving signal, thereby causing formation of a bubble in the ink.

24. An ink jet recording apparatus according to claim 23, wherein the ink is discharged through the discharge port in accordance with growth and shrinkage of the bubble.

25. An ink jet recording apparatus for use with a recording head unit having a discharge port face having a discharge port for discharging ink, the recording head unit being scanned in a main scan direction across a conveyance direction of a recording medium, and a first cleaning member for cleaning said ink discharge port face, said apparatus comprising:

a second cleaning member for cleaning the first cleaning member while being in contact therewith; and means for setting a first cleaning mode of cleaning said discharge port face with the first cleaning member and a second cleaning mode of cleaning the first cleaning member with said second cleaning member, wherein said second cleaning member is scanned in the main scan direction together with the recording head unit, and in the second cleaning mode the first cleaning member is at a position so that a contact area between the first cleaning member and said second cleaning member is larger than a contact area between the first cleaning member and the discharge port face in the first cleaning mode.

26. An ink jet recording apparatus according to claim 25, wherein the recording head unit includes heat generating means for generating heat energy used to discharge the ink.

27. An ink jet recording apparatus according to claim 26, wherein said heat generating means causes rapid temperature elevation exceeding nucleate boiling in the ink in accordance with a driving signal, thereby causing formation of a bubble in the ink.

28. An ink jet recording apparatus according to claim 27, wherein the ink is discharged through the discharge port in accordance with growth and shrinkage of the bubble.

29. An ink jet recording apparatus for use with a recording head unit having a discharge port face having a discharge port for discharging ink, said apparatus comprising:

a first cleaning member for cleaning said ink discharge port face;

a second cleaning member for cleaning said first cleaning member while being in contact therewith, said second cleaning member being integral with said recording head unit; and means for setting a first cleaning mode of cleaning said discharge port face with said first cleaning member and a second cleaning mode of cleaning said first cleaning member with said second cleaning member, wherein a relative moving speed of the first cleaning member and said second cleaning member in the second cleaning mode is set to be slower than a relative moving speed of the first cleaning member and said discharge port face in the first cleaning mode.

30. An ink jet recording apparatus according to claim 29, wherein the recording head unit includes heat generating means for generating heat energy used to discharge the ink.

31. An ink jet recording apparatus according to claim 30, wherein said heat generating means causes rapid temperature elevation exceeding nucleate boiling in the ink in accordance with a driving signal, thereby causing formation of a bubble in the ink.

32. An ink jet recording apparatus according to claim 31, wherein the ink is discharged through the discharge port in accordance with growth and shrinkage of the bubble.

33. An ink jet recording apparatus for use with a recording head unit having a discharge port face having a discharge port for discharging ink, the recording head unit being scanned in a main scan direction across a conveyance direction of a recording medium, and a first cleaning member for cleaning said ink discharge port face, said apparatus comprising:

a second cleaning member for cleaning the first cleaning member while being in contact therewith; and means for setting a first cleaning mode of cleaning said discharge port face with the first cleaning member and a second cleaning mode of cleaning the first cleaning member with said second cleaning member, wherein said second cleaning member is scanned in the main scan direction together with the recording head unit, and a relative moving speed of the first cleaning member and said second cleaning member in the second cleaning mode is set to be slower than a relative moving speed of the first cleaning member and said discharge port face in the first cleaning mode.

34. An ink jet recording apparatus according to claim 33, wherein the recording head unit includes heat generating means for generating heat energy used to discharge the ink.

35. An ink jet recording apparatus according to claim 34, wherein said heat generating means causes rapid temperature elevation exceeding nucleate boiling in the ink in accordance with a driving signal, thereby causing formation of a bubble in the ink.

36. An ink jet recording apparatus according to claim 35, wherein the ink is discharged through the discharge port in accordance with growth and shrinkage of the bubble.

* * * * *